US012268282B2

(12) United States Patent
Beers et al.

(10) Patent No.: US 12,268,282 B2
(45) **Date of Patent: *Apr. 8, 2025**

(54) ARTICLE OF FOOTWEAR WITH A TENSIONING SYSTEM INCLUDING A GUIDE ASSEMBLY

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/735,831

(22) Filed: May 3, 2022

(65) Prior Publication Data

US 2022/0256975 A1 Aug. 18, 2022

Related U.S. Application Data

(63) Continuation of application No. 16/210,120, filed on Dec. 5, 2018, now Pat. No. 11,324,284, which is a continuation of application No. 15/070,164, filed on Mar. 15, 2016, now Pat. No. 10,201,212.

(51) Int. Cl.

| | |
|---|---|
| ***A43B 13/12*** | (2006.01) |
| ***A43B 3/34*** | (2022.01) |
| ***A43B 13/18*** | (2006.01) |
| ***A43C 11/00*** | (2006.01) |
| ***A43C 11/16*** | (2006.01) |

(52) U.S. Cl.

CPC ..... *A43C 11/165* (2013.01); *A43B 3/34* (2022.01); *A43C 11/008* (2013.01)

(58) Field of Classification Search

None

See application file for complete search history.

(56) References Cited

U.S. PATENT DOCUMENTS

| | | | |
|---|---|---|---|
| 5,117,567 | A | 6/1992 | Berger |
| 5,205,055 | A | 4/1993 | Harrell |
| 5,651,197 | A | 7/1997 | James |

(Continued)

FOREIGN PATENT DOCUMENTS

| | | |
|---|---|---|
| CN | 102014682 | 4/2011 |
| CN | 104080362 | 10/2014 |

(Continued)

OTHER PUBLICATIONS

"Japanese Application Serial No. 2022-081629, Notification of Reasons for Refusal mailed Jan. 16, 2024", With English Machine Translation, 11 pgs.

(Continued)

*Primary Examiner* — Jila M Mohandesi

(74) *Attorney, Agent, or Firm* — Schwegman, Lundberg & Woessner, P.A.

(57) ABSTRACT

An article with an automatic tensioning system includes a lace guide assembly. The lace guide assembly includes a lower guide member and two upper guide members that include channels for routing a tensioning member. Straps of the upper are attached to the two upper guide members. As the tensioning member is pulled into a tensioning device, the two upper guide members are pulled toward the lower guide member. This pulls on the straps and acts to tighten the upper around a foot.

15 Claims, 17 Drawing Sheets

(56) References Cited

U.S. PATENT DOCUMENTS

| | | | | |
|---|---|---|---|---|
| 5,791,021 | A | 8/1998 | James | |
| 5,839,210 | A * | 11/1998 | Bernier | A43B 1/0072 36/50.1 |
| 5,906,057 | A | 5/1999 | Borsoi | |
| 5,934,599 | A * | 8/1999 | Hammerslag | A43C 1/00 242/396.1 |
| 6,032,387 | A | 3/2000 | Johnson | |
| 6,289,558 | B1 * | 9/2001 | Hammerslag | A43B 5/16 24/68 SK |
| 6,922,917 | B2 * | 8/2005 | Kerns | A43B 5/14 36/50.1 |
| 8,046,937 | B2 * | 11/2011 | Beers | A43C 1/00 36/50.1 |
| 8,747,340 | B2 | 6/2014 | Gerber et al. | |
| 8,769,844 | B2 | 7/2014 | Beers et al. | |
| 9,365,387 | B2 | 6/2016 | Beers et al. | |
| 10,201,212 | B2 | 2/2019 | Beers et al. | |
| 11,324,284 | B2 | 5/2022 | Beers et al. | |
| 2003/0150135 | A1 | 8/2003 | Liu | |
| 2004/0181972 | A1 | 9/2004 | Csorba | |
| 2005/0022427 | A1 | 2/2005 | Kerns et al. | |
| 2005/0198866 | A1 | 9/2005 | Wiper et al. | |
| 2006/0000116 | A1 | 1/2006 | Brewer | |
| 2007/0209234 | A1 | 9/2007 | Chou | |
| 2008/0301919 | A1 | 12/2008 | Ussher | |
| 2009/0199435 | A1 | 8/2009 | Robinson, Jr. et al. | |
| 2012/0240428 | A1 | 9/2012 | Knoll | |
| 2012/0291242 | A1 | 11/2012 | Donnadieu | |
| 2013/0086816 | A1 | 4/2013 | Johnson et al. | |
| 2013/0104429 | A1 | 5/2013 | Torres | |
| 2014/0068838 | A1 | 3/2014 | Beers et al. | |
| 2014/0082963 | A1 | 3/2014 | Beers | |
| 2014/0259783 | A1 | 9/2014 | Dinndorf et al. | |
| 2014/0360047 | A1 | 12/2014 | Beers et al. | |
| 2015/0289594 | A1 | 10/2015 | Rushbrook et al. | |
| 2015/0289595 | A1 | 10/2015 | Rushbrook et al. | |
| 2016/0058129 | A1 | 3/2016 | Krueger | |
| 2017/0265574 | A1 | 9/2017 | Beers et al. | |
| 2019/0208864 | A1 | 7/2019 | Beers et al. | |

FOREIGN PATENT DOCUMENTS

| | | |
|---|---|---|
| CN | 104507346 | 4/2015 |
| CN | 109068807 | 12/2018 |
| CN | 111685450 | 9/2020 |
| EP | 1611810 | 1/2006 |
| EP | 3429401 | 12/2020 |
| EP | 3799760 | 8/2023 |
| JP | H06502775 | 3/1994 |
| JP | H09191906 | 7/1997 |
| JP | 2004222782 | 8/2004 |
| JP | 2011519611 | 7/2011 |
| JP | 2019509823 | 4/2019 |
| JP | 7077232 | 5/2022 |
| JP | 2022126640 | 8/2022 |
| KR | 102371737 | 3/2022 |
| KR | 20220035267 | 3/2022 |
| KR | 102563651 | 8/2023 |
| KR | 20230119727 | 8/2023 |
| WO | 9811797 | 3/1998 |
| WO | 2006007782 | 1/2006 |
| WO | 2009134858 | 11/2009 |
| WO | 2017160642 | 9/2017 |

OTHER PUBLICATIONS

"Japanese Application Serial No. 2022-081629, Response Filed Dec. 25, 2023 to Notification of Reasons for Refusal mailed Jul. 4, 2023", w English Claims, 9 pgs.
"European Application Serial No. 23193459.7, Extended European Search Report mailed Mar. 4, 2024", 9 pgs.
"International Application Serial No. PCT US2017 021836, International Search Report mailed Jun. 23, 2017", 4 pgs.
"International Application Serial No. PCT US2017 021836, Written Opinion mailed Jun. 23, 2017", 7 pgs.
"U.S. Appl. No. 15/070,164, Non Final Office Action mailed Apr. 13, 2018", 7 pgs.
"U.S. Appl. No. 15/070,164, Response filed Jul. 10, 2018 to Non Final Office Aciton mailed Apr. 13, 2018", 10 pgs.
"U.S. Appl. No. 15/070,164, Notice of Allowance mailed Sep. 21, 2018", 6 pgs.
"International Application Serial No. PCT US2017 021836, International Preliminary Report on Patentability mailed Sep. 27, 2018", 9 pgs.
"U.S. Appl. No. 15/070,164, Notice of Allowability mailed Dec. 6, 2018", 2 pgs.
"U.S. Appl. No. 16/210,120, Preliminary Amendment filed Apr. 3, 2019", 8 pgs.
"European Application Serial No. 17767214.4, Response filed Apr. 24, 2019 to Communication Pursuant to Rules 161 and 162 mailed Nov. 5, 2018", 29 pgs.
"Chinese Application Serial No. 201780027763.7, Voluntary Amendment filed Jul. 4, 2019", w English claims, 34 pgs.
"Chinese Application Serial No. 201780027763.7, Office Action mailed Sep. 3, 2019", w English translation, 9 pgs.
"European Application Serial No. 17767214.4, Extended European Search Report mailed Nov. 7, 2019", 5 pgs.
"Chinese Application Serial No. 201780027763.7, Response filed Jan. 19, 2020 to Office Action mailed Sep. 3, 2019", w English claims, 18 pgs.
"European Application Serial No. 17767214.4, Response filed Apr. 24, 2020 to Extended European Search Report mailed Nov. 7, 2019", 1 pg.
"U.S. Appl. No. 16/210,120, Restriction Requirement mailed Jun. 17, 2020", 7 pgs.
"U.S. Appl. No. 16/210,120, Response filed Oct. 14, 2020 to Restriction Requirement mailed Jun. 17, 2020", 6 pgs.
"U.S. Appl. No. 16/210,120, Non Final Office Action mailed Jan. 28, 2021", 11 pgs.
"European Application Serial No. 20210391.7, Extended European Search Report mailed Mar. 11, 2021", 8 pgs.
"U.S. Appl. No. 16/210,120, Examiner Interview Summary mailed Apr. 5, 2021", 2 pgs.
"Japanese Application Serial No. 2018-549267, Notification of Reasons for Refusal mailed Apr. 6, 2021", With English machine translation, 12 pgs.
"Korean Application Serial No. 10-2018-7029687, Notice of Preliminary Rejection mailed May 18, 2021", w English Translation, 5 pgs.
"Chinese Application Serial No. 202010418205.7, Office Action mailed Jun. 17, 2021", With English translation, 18 pgs.
"U.S. Appl. No. 16/210,120, Response filed Jul. 28, 2021 to Non Final Office Action mailed Jan. 28, 2021", 8 pgs.
"U.S. Appl. No. 16/210,120, Final Office Action mailed Aug. 31, 2021", 12 pgs.
"Japanese Application Serial No. 2018-549267, Response filed Aug. 18, 2021 to Notification of Reasons for Refusal mailed Apr. 6, 2021", w English claims, 11 pgs.
"Korean Application Serial No. 10-2018-7029687, Response filed Aug. 17, 2021 to Notice of Preliminary Rejection mailed May 18, 2021", w English claims, 22 pgs.
"Japanese Application Serial No. 2018-549267, Final Notification of Reasons for Refusal mailed Oct. 5, 2021", w English translation, 5 pgs.
"European Application Serial No. 20210391.7, Response filed Sep. 13, 2021 to Extended European Search Report mailed Mar. 11, 2021", 29 pgs.
"U.S. Appl. No. 16/210,120, Response filed Nov. 30, 2021 to Final Office Action mailed Aug. 31, 2021", 8 pgs.
"U.S. Appl. No. 16/210,120, Notice of Allowance mailed Jan. 6, 2022", 9 pgs.
"Chinese Application Serial No. 202010418205.7, Response filed Jan. 4, 2022 to Office Action mailed Jun. 17, 2021", w English claims, 15 pgs.
"European Application Serial No. 20210391.7, Communication Pursuant to Article 94(3) EPC mailed Feb. 2, 2022", 4 pgs.

(56) References Cited

OTHER PUBLICATIONS

"U.S. Appl. No. 16/210,120, Supplemental Notice of Allowability mailed Mar. 25, 2022", 3 pgs.
"Japanese Application Serial No. 2018-549267, Response filed Apr. 5, 2022 to Final Notification of Reasons for Refusal mailed Oct. 5, 2021", w English claims, 12 pgs.
"Japanese Application Serial No. 2022-081629, Voluntary Amendment filed Jun. 23, 2022", w English claims, 10 pgs.
"Korean Application Serial No. 10-2022-7007160, Notice of Preliminary Rejection mailed Jul. 6, 2022", w English Translation, 6 pgs.
"Korean Application Serial No. 10-2022-7007160, Voluntary Amendment filed Apr. 1, 2022", w English claims, 18 pgs.
"Korean Application Serial No. 10-2022-7007160, Response filed Dec. 27, 2022 to Notice of Preliminary Rejection mailed Jul. 6, 2022", w English claims, 13 pgs.
"European Application Serial No. 20210391.7, Response filed Jun. 9, 2022 to Communication Pursuant to Article 94(3) EPC mailed Feb. 2, 2022", 11 pgs.
"Japanese Application Serial No. 2022-081629, Notification of Reasons for Refusal mailed Jul. 4, 2023", w English Translation, 7 pgs.
"Korean Application Serial No. 10-2023-7026164, Notice of Preliminary Rejection mailed Mar. 31, 2024", w English translation, 5 pgs.
"Japanese Application Serial No. 2022-081629, Response filed Jul. 16, 2024 to Notification of Reasons for Refusal mailed Jan. 16, 2024", w current English claims, 13 pgs.
"Japanese Application Serial No. 2022-081629, Examiners Decision of Final Refusal mailed Jul. 30, 2024", W English Translation, 6 pgs.
"Korean Application Serial No. 10-2023-7026164, Response filed Sep. 30, 2024 to Notice of Preliminary Rejection mailed Mar. 31, 2024", w current English claims, 11 pgs.
"European Application Serial No. 23193459.7, Response filed Sep. 26, 2024 to Extended European Search Report mailed Mar. 4, 2024", 39 pgs.

* cited by examiner

ARTICLE OF FOOTWEAR WITH A TENSIONING SYSTEM INCLUDING A GUIDE ASSEMBLY

BACKGROUND

The present embodiments relate generally to articles of footwear, and in particular to systems for tensioning articles of footwear.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one embodiment, an article of footwear includes an upper and a sole structure, the upper including a first side and a second side, the first side and the second side spaced apart at a throat of the upper by a throat opening. The first side is comprised of an inner layer and an outer layer and has an interior cavity between the inner layer and the outer layer. The article includes a first set of strap members and a second set of strap members as well as a lower guide member disposed in the first side between the inner layer and the outer layer and proximate the sole structure. The article also includes a first upper guide member disposed in the first side between the inner layer and the outer layer and a second upper guide member disposed in the first side between the inner layer and the outer layer, where the first upper guide member is disposed closer to the throat opening than the lower guide member and where the second upper guide member is disposed closer to the throat opening than the lower guide member. The first set of strap members is each secured at one end to the second side and at an opposing end to the first upper guide member, and the second set of strap members is secured at one end to the second side and at an opposing end to the second upper guide member. The article includes a tensioning member routed from the lower guide member to the first upper guide member, and from the first upper guide member back to the lower guide member, the tensioning member being further routed along a set distance of the lower guide member and then up to the second upper guide member, and from the second upper guide member back to the lower guide member. At least one segment of the tensioning member is routed from the lower guide member to a location outside of the interior cavity. The first upper guide member has a first longitudinal position with respect to a longitudinal axis of the article of footwear and wherein the second upper guide member has a second longitudinal position with respect to the longitudinal axis. At least a portion of the lower guide member extends from the first longitudinal position along the longitudinal axis to the second longitudinal position.

In another aspect, an article of footwear includes an upper and a sole structure. The upper includes a first side and a second side, where the first side and the second side are spaced apart along a throat of the upper by a throat opening. The first side includes an inner layer and an outer layer and includes an interior cavity between the inner layer and the outer layer. The article includes a set of strap members, a lower guide member disposed in the first side between the inner layer and the outer layer and proximate the sole structure, and an upper guide member disposed in the first side between the inner layer and the outer layer. The upper guide member is disposed closer to the throat opening than the lower guide member. The set of strap members is secured at one end to the second side of the upper and at an opposing end to the upper guide member. The article also includes a tensioning member and a tensioning device including a motor and a reel coupled with the motor. At least one portion of the tensioning member is secured to the reel and can be wound on the reel using the motor. The tensioning member is routed along a path beginning at the reel of the tensioning device, and passing through the lower guide member and the upper guide member.

In another aspect, an article of footwear includes an upper and a sole structure, the upper including a first side and a second side, where the first side and the second side are spaced apart along a throat of the upper by a throat opening. The first side includes an inner layer and an outer layer and includes an interior cavity between the inner layer and the outer layer. The article includes a lace guide assembly disposed inside the interior cavity, where the lace guide assembly includes a lower guide member, a first upper guide member, and a second upper guide member. The first upper guide member and the second upper guide member are each attached to a plurality of straps for securing the throat opening. The article also includes a tensioning member routed into the interior cavity and through the lace guide assembly and then routed back out of the interior cavity. Applying tension to the tensioning member applies tension to each of the plurality of straps attached to the first guide member and the second guide member.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
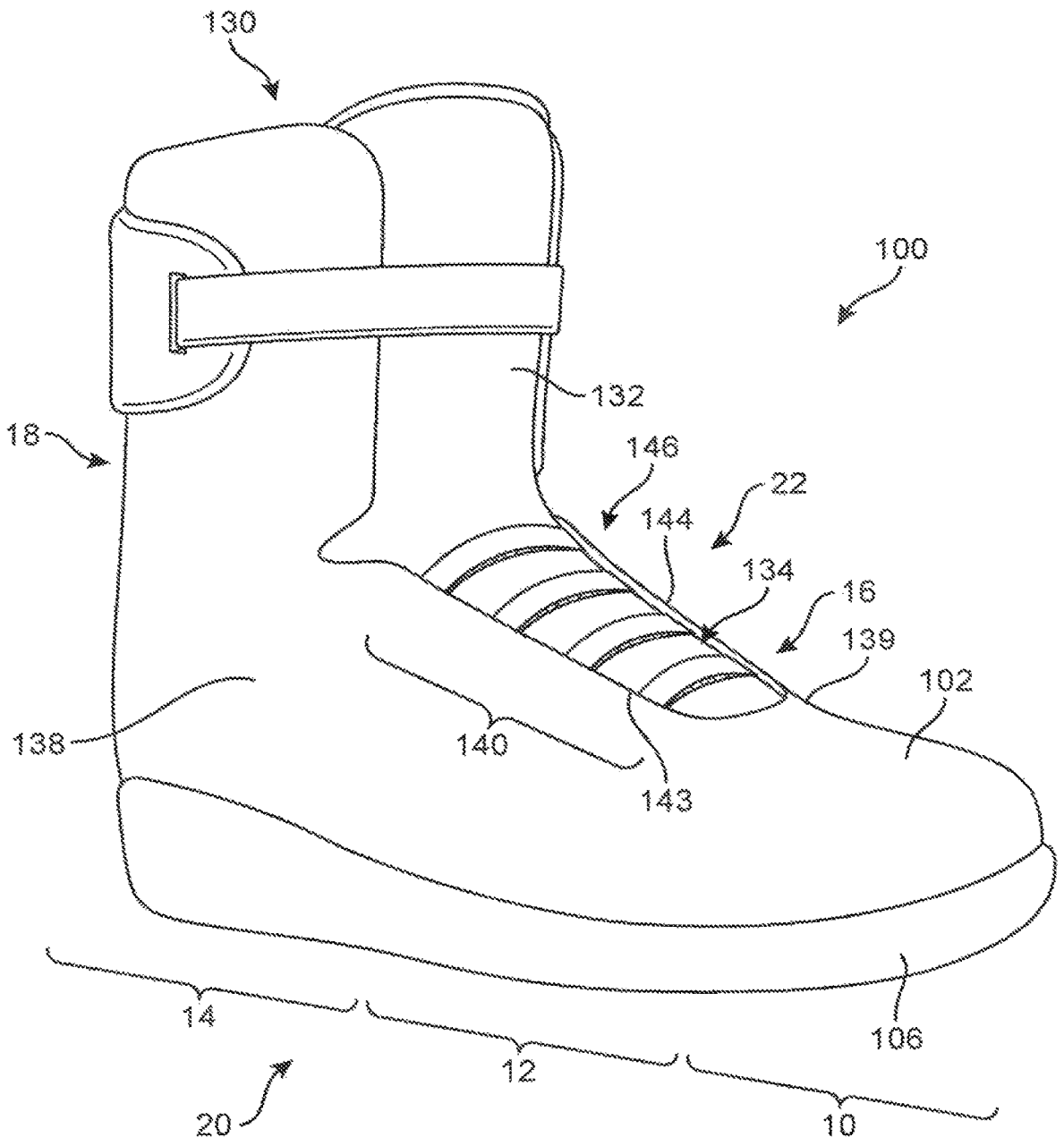
FIG. 1 is a schematic view of an embodiment of an article of footwear including a tensioning system.

FIG. 1 is a schematic isometric view of article of footwear 100 that further includes an automated tensioning system. In one embodiment, article of footwear 100 has the form of an athletic shoe. The provisions discussed herein for an automated tensioning system could be incorporated into various other kinds of footwear including, but not limited to, basketball shoes, hiking boots, soccer shoes, football shoes, tennis shoes, climbing shoes, sneakers, running shoes, cross-training shoes, rugby shoes, rowing shoes, baseball shoes as well as other kinds of shoes. Moreover, in some embodiments, the provisions discussed herein could be incorporated into various other kinds of non-sports-related footwear, including, but not limited to, slippers, sandals, high-heeled footwear, and loafers. In the embodiment shown in FIG. 1, article of footwear 100 has the form of a high-top sneaker.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of an upper, a sole structure, or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some embodiments, a longitudinal direction may extend from a forefoot portion to a heel portion of the component. Also, the term "lateral" as used throughout this detailed description and in the claims refers to a direction or axis extending along a width of a component. For example, a lateral direction may extend between a medial side and a lateral side of a component. Furthermore, the term "vertical" as used throughout this detailed description and in the claims refers to a direction or axis generally perpendicular to a lateral and longitudinal direction. For example, in embodiments where an article is planted flat on a ground surface, a vertical direction may extend from the ground surface upward. Additionally, the term "inner" or "proximal" refers to a portion of an article disposed closer to an interior of an article, or closer to a foot when the article is worn. Likewise, the term "outer" or "distal" refers to a portion of an article disposed further from the interior of the article or from the foot. Thus, for example, the proximal surface of a component is disposed closer to an interior of the article than the distal surface of the component. This detailed description makes use of these directional adjectives in describing an article and various components of the article, including an upper, a midsole structure, and/or an outer sole structure.

Article 100 may be characterized by a number of different regions or portions. For example, article 100 could include a forefoot region, a midfoot region, a heel region, a vamp region, an instep region, and an ankle region. Moreover, components of article 100 could likewise comprise corresponding regions or portions. Referring to FIG. 1, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. Article 100 may also include instep region 16 and ankle region 18.

Furthermore, for purposes of reference, article 100 may include lateral side 20 and medial side 22. In particular, lateral side 20 and medial side 22 may be opposing sides of article 100. Furthermore, both lateral side 20 and medial side 22 may extend through forefoot region 10, midfoot region 12, heel region 14.

Article 100 may comprise upper 102 and sole structure 106. In different embodiments, sole structure 106 may be configured to provide traction for article 100. Thus, in some embodiments, traction elements may be included in sole structure 106. In addition to providing traction, sole structure 106 may attenuate ground reaction forces when compressed between the foot and the ground during walking, running, pushing, or other ambulatory activities. The configuration of sole structure 106 may vary significantly in different embodiments to include a variety of conventional or nonconventional structures. In some embodiments, sole structure 106 can be configured according to one or more types of surfaces on which sole structure 106 may be used. Examples of surfaces include, but are not limited to, natural turf, synthetic turf, dirt, hardwood flooring, skims, wood, plates, footboards, boat ramps, as well as other surfaces.

The various portions of sole structure 106 may be formed from a variety of materials. For example, sole structure 106 may include a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, sole structure 106 may incorporate fluid-filled chambers, plates, moderators, or other elements that further attenuate forces, enhance stability, or influence the motions of the foot. Furthermore, other portions of sole structure 106, such as an outsole, can be formed from a wear-resistant rubber material that is textured to impart traction. It should be understood that the embodiments herein depict a configuration for sole structure 106 as an example of a sole structure that may be used in connection with upper 102, and a variety of other conventional or nonconventional configurations for sole structure 106 may also be utilized. Accordingly, the structure and features of sole structure 106 or any sole structure utilized with upper 102 may vary considerably.

Sole structure 106 is secured to upper 102 and extends between a foot and the ground when article 100 is worn. In different embodiments, sole structure 106 may include different components. For example, sole structure 106 may include an outsole. Sole structure 106 may further include a midsole and/or an insole. In some embodiments, one or more of these components may be optional.

In different embodiments, upper 102 may be joined to sole structure 106 and define an interior cavity or interior void designed to receive a wearer's foot. In some embodiments, upper 102 includes opening 130 that provides access for the foot into an interior cavity of upper 102. Opening 130 may be disposed along or near ankle region 18 in some embodiments. As seen in FIG. 1, in one embodiment upper 102 also includes tongue 132. Tongue 132 may be disposed against throat opening 134 (along instep region 16 of upper 102) and tongue 132 may block access to the interior cavity of upper 102 via throat opening 134. Throat opening 134 may also be seen to separate first side 138 and second side 139 of upper 102.

In some embodiments, article 100 can include lacing area 140. In some embodiments, lacing area 140 may be associated with throat opening 134, including areas corresponding to an instep of the foot in midfoot region 12 to an area adjacent to forefoot region 10. Lacing area 140 extends between lateral lacing edge 143 and medial lacing edge 144 on opposite sides of upper 120.

To secure upper 102 around a foot, article 100 may include one or more lacing or tensioning provisions that facilitate opening and closing throat opening 134. Some embodiments may use a conventional lacing system with a lace or other tensioning member secured through eyelets or similar fastening provisions along the edges of lacing area 140. In other embodiments, article 100 can include other lacing or tensioning provisions. In some embodiments, article 100 can include tensioning provisions that facilitate automatic tightening and loosening of upper 102 around a foot.

In this embodiment, plurality of strap members 146 (or simply, strap members 146) extends across portions of lacing area 140. Together with other provisions of a tensioning system (described in detail below), plurality of strap members 146 assist the wearer to modify dimensions of upper 102 to accommodate the proportions of the foot. In the exemplary embodiments, plurality of strap members 146 extend laterally across lacing area 140 between lateral edge 143 and medial edge 144. As will be further described below, plurality of strap members 146 and a tensioning member of a tensioning system permit the wearer to tighten upper 102 around the foot, and to loosen upper 102 to facilitate entry and removal of the foot from the interior void (i.e., through throat opening 134).

In some embodiments, tongue 132 extends over a foot of a wearer when disposed within article 100 to enhance the comfort of article 100. In this embodiment, tongue 132 extends through lacing area 140 and can move within an opening between opposite lateral edge 143 and medial edge 144 of upper 102. In some cases, tongue 132 can extend between a lace and/or plurality of strap members 146 to provide cushioning and disperse tension applied by the lace or plurality of strap members 146 against a top of a foot of a wearer. With this arrangement, tongue 132 can enhance the comfort of article 100.

Some embodiments may include provisions for facilitating the adjustment of an article to a wearer's foot, including tightening and/or loosening the article around the wearer's foot. In some embodiments, these provisions may include a tensioning system. In some embodiments, a tensioning system may further include other components that include, but are not limited to, a tensioning member, lacing guides, a tensioning assembly, a housing unit, a motor, gears, spools or reels, and/or a power source. Such components may assist in securing, adjusting tension, and providing a customized fit to a wearer's foot. These components and how, in various embodiments, they may secure the article to a wearer's foot, adjust tension, and provide a customized fit will be explained further in detail below.

Figure 2:
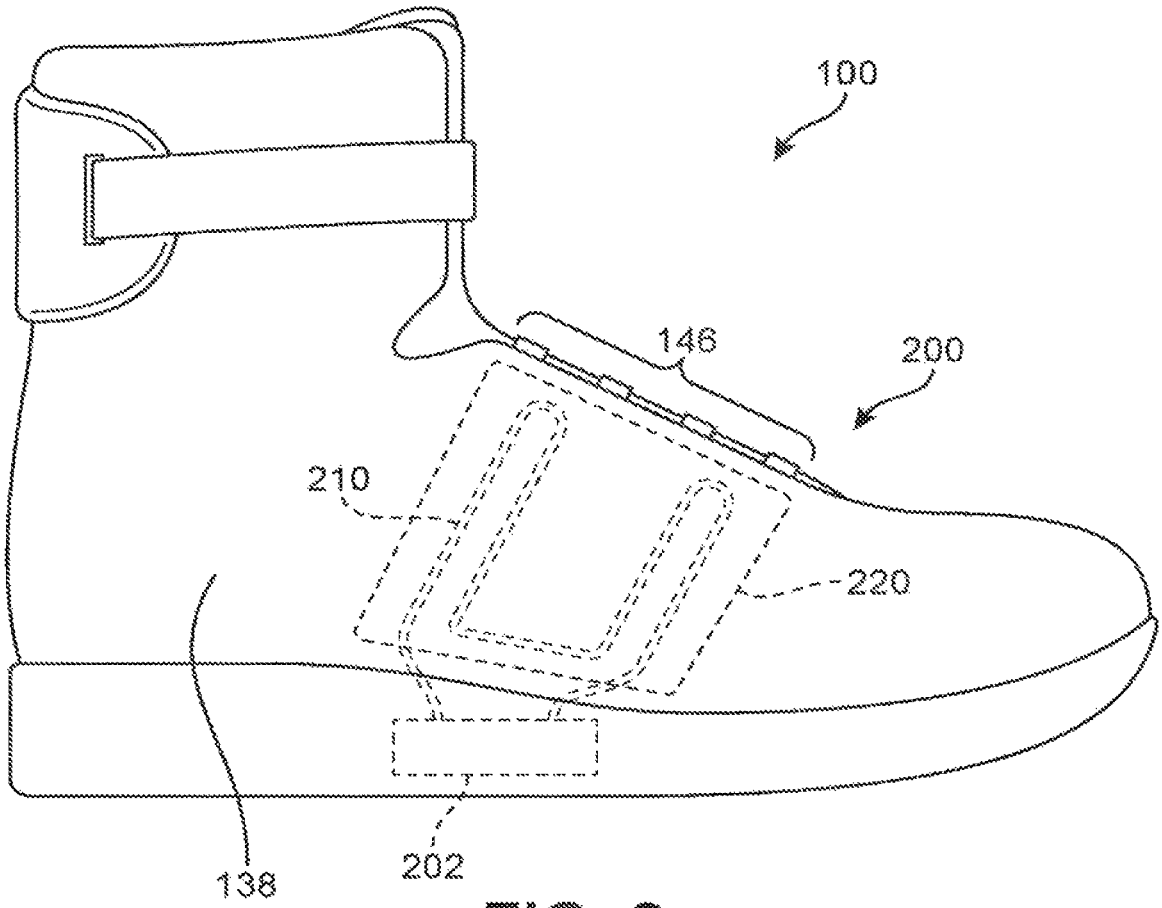
FIG. 2 is a side schematic view of an embodiment of the article of FIG. 1.

FIG. 2 is a schematic side view of an embodiment of article 100. Referring now to FIG. 2, article 100 includes an exemplary embodiment of tensioning system 200. Embodiments of tensioning system 200 may include any suitable tensioning system, including incorporating any of the systems, components, features, or elements disclosed in one or more of Beers et at, U.S. Patent Application Publication Number 2014/0068838, now U.S. application Ser. No. 14/014,491, filed Aug. 20, 2013, and titled "Motorized Tensioning System"; Beers, U.S. Patent Application Publication Number 2014/0070042, now U.S. application Ser. No. 14/014,555, filed Aug. 20, 2013 and titled "Motorized Tensioning System with Sensors"; and Beers, U.S. Patent Application Publication Number 2014/0082963, now U.S. application Ser. No. 14/032,524, filed Sep. 20, 2013 and titled "Footwear Having Removable Motorized Adjustment System"; which applications are hereby incorporated by reference in their entirety (collectively referred to herein as the "Automatic Lacing cases").

For purposes of clarity, some components or subsystems of tensioning system 200 are shown schematically in FIG. 2, so as to facilitate an understanding of their respective locations in article 100 and relations to one another. In the embodiment of FIG. 2, article 100 includes tensioning device 202. Tensioning device 202 may include one or more provisions for automatically increasing or decreasing tension of a lace, or other tensioning member, in tensioning system 200. As discussed in further detail below, such provisions may include a motor, a spool for winding a lace, and power provisions (e.g., a battery).

In different embodiments, a tensioning system may include a tensioning member. The term "tensioning member" as used throughout this detailed description and in the claims refers to any component that has a generally elongated shape and high tensile strength. In some cases, a tensioning member could also have a generally low elasticity. Examples of different tensioning members include, but are not limited to, laces, cables, straps, and cords. In some cases, tensioning members may be used to fasten and/or tighten an article, including articles of clothing and/or footwear. In other cases, tensioning members may be used to apply tension at a predetermined location for purposes of actuating some components or system.

In the embodiment of FIG. 2, article 100 includes tensioning member 210, Tensioning member 210, which is indicated schematically in FIG. 2, may be configured as a lace, cable, cord, or any other kind of tensioning member. In the exemplary embodiment of FIGS. 1-3, tensioning member 210 may be a lace with a generally circular cross-sectional shape. Tensioning member 210 may be associated with tensioning device 202 (for example, tensioning member 210 may be wound around a spool of tensioning device 202). Tensioning member 210 may also be associated with one or more of plurality of strap members 146. In particular, tensioning member 210 may be configured to transmit tension to plurality of strap members 146 as tensioning member 210 is wound around a spool of tensioning device 202.

Figure 3:
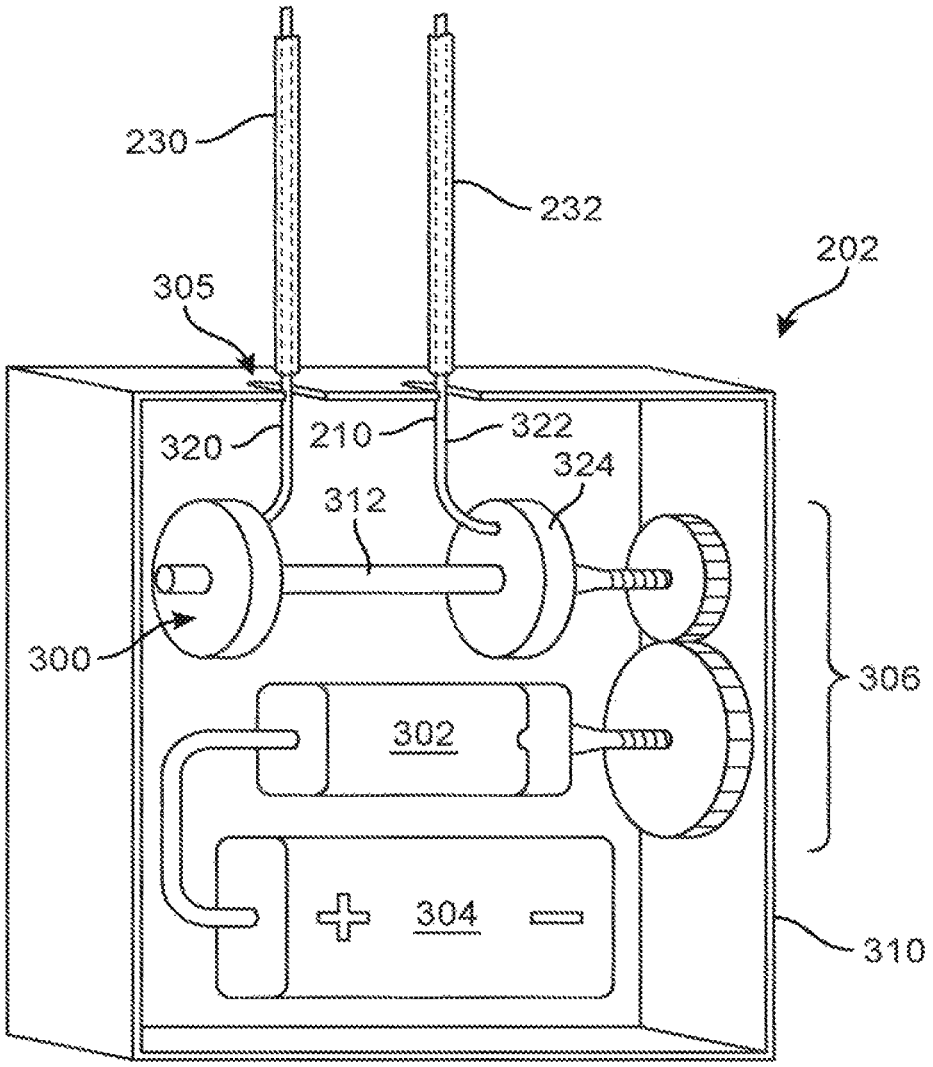
FIG. 3 is a schematic view of an embodiment of a tensioning device used with an article of footwear.

FIG. 3 is a schematic view of an embodiment of tensioning device 202 coupled with tensioning member 210. Tensioning device 202 may include reel member 300 (or spool), motor 302, and power source 304. Thus, power source 304 may power motor 302 to turn reel member 300. In some embodiments, motor 302 and reel member 300 could be further coupled using gear assembly 306.

In an exemplary embodiment, reel member 300 is a reel or spool having shaft 312 running along the central axis and one or more flanges 324 extending radially outward from shaft 312. One or more flanges 324 can have a generally circular or round shape with shaft 312 disposed within the center of each flange. In some other embodiments, a central flange (not shown) could assist in keeping wound portions of tensioning member 210 separated and organized on reel member 300 so that tensioning member 210 does not become tangled or bird-nested during winding or unwinding when tensioning system 200 is tightened or loosened.

In some embodiments, motor 302 could include an electric motor. However, in other embodiments, motor 302 could comprise any kind of non-electric motor known in the art. Examples of different motors that can be used include, but are not limited to, DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Motor 302 may further include a crankshaft that can be used to drive one or more components of a tensioning system. For example, a crankshaft of motor 302 may drive gear assembly 306, which is also coupled to reel member 300. With this arrangement, reel member 300 may be placed in communication with motor 302 to be rotated in opposite directions around a central axis.

Power source 304 may include a battery and/or control unit (not shown) configured to power and control motor 302. Power source 304 may be any suitable battery of one or more types of battery technologies that could be used to power motor 302 and tensioning system 200. One possible battery technology that could be used is a lithium polymer battery. The battery (or batteries) could be rechargeable or replaceable units packaged as flat, cylindrical, or coin shaped. In addition, batteries could be single cell or cells in series or parallel. Other suitable batteries and/or power sources may be used for power source 304.

In the embodiments shown, reel member 300, motor 302, power source 304, and gear assembly 306 are all disposed in housing unit 310, along with additional components, such as a control unit or other elements, which may function to receive and protect all of these components within tensioning device 202. In other embodiments, however, any one or more of these components could be disposed in any other portions of an article, including the upper and/or sole structure.

Housing unit 310 includes openings 305 that permit tensioning member 210 to enter into housing unit 310 and engage reel member 300. Accordingly, openings 305 in housing unit 310 allow first member portion 320 and second member portion 322 of tensioning member 210 to wind and unwind around reel member 300 within the inside of housing unit 310.

Figure 4:
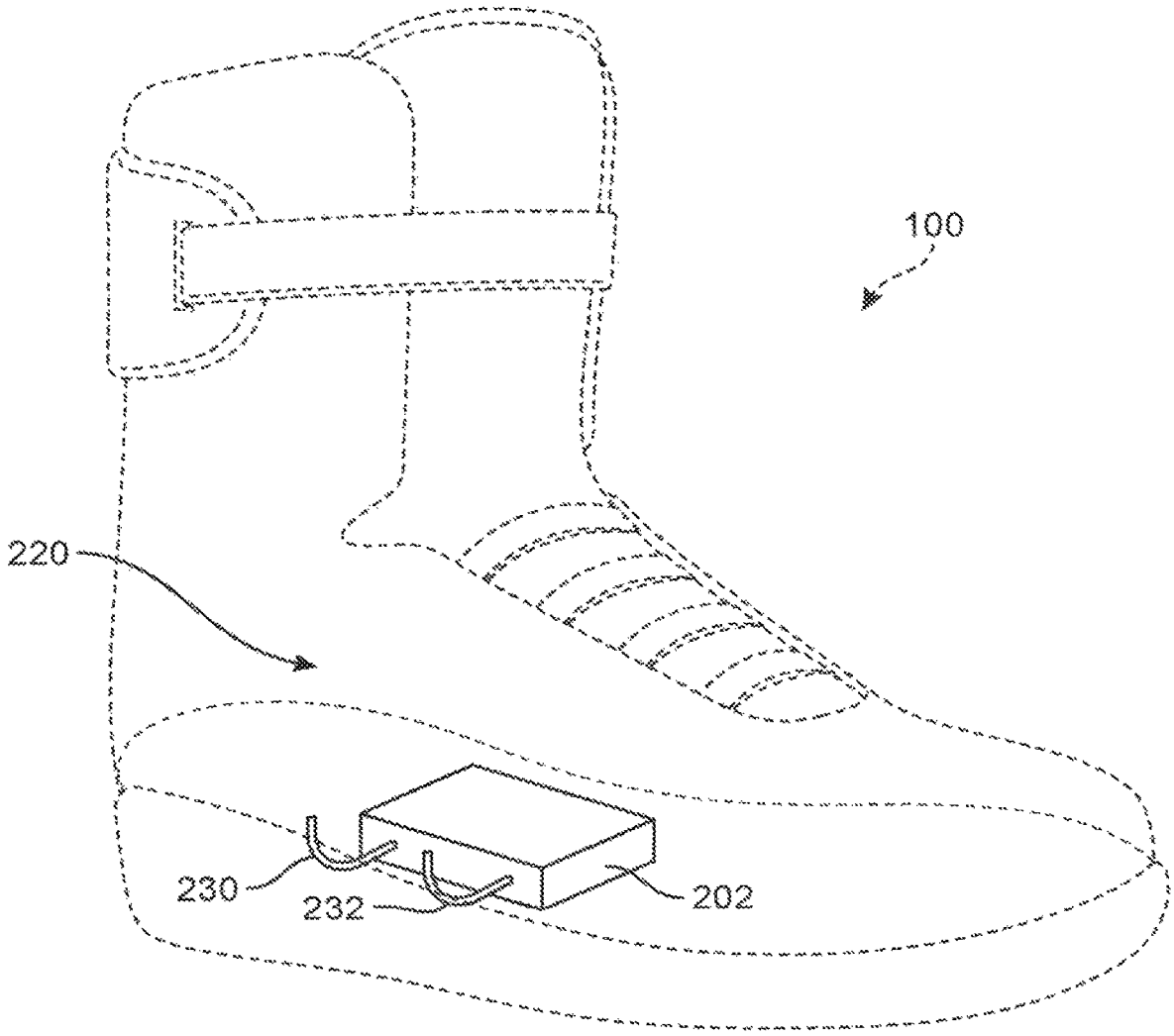
FIG. 4 is a schematic isometric view the article of FIG. 1, in which a tensioning device is seen to be disposed in a sole structure.

As indicated in FIG. 2, and also shown in FIG. 4, tensioning device 202 may be disposed within sole structure 106. In some embodiments, sole structure 106 may include a cavity or recess that receives tensioning device 202. In other embodiments, tensioning device 202 could be secured within other regions of article 100, including, for example, being externally secured to upper 102 using a harness or other attachment provisions.

To facilitate guiding tensioning member 210 between tensioning device 202 and plurality of strap members 146, article 100 may also include a tensioning member guide assembly, also referred to as a lace guide assembly. For purposes of illustration, FIG. 2 highlights lace guide assembly area 220 using dotted lines. Lace guide assembly area 220 may be disposed in first side 138 of upper 102. In at least some embodiments, components of a lace guide assembly, and associated portions of a tensioning member, may be disposed internally and not visible on an external surface of upper 102. For example, as described below, in at least some embodiments, components of a lace guide assembly are secured between an inner and outer layer of upper 102 and thereby hidden to a user.

Embodiments can also include provisions that facilitate the passage of portions of tensioning member 210 between tensioning device 202, which may be secured in sole structure 106, and lace guide assembly area 220, which is part of upper 102. To this end, and referring now to FIGS. 3-4, some embodiments of tensioning system 200 may include first guide tube 230 and second guide tube 232. First guide tube 230 and second guide tube 232 may be mounted within sole structure 106 and/or between sole structure 106 and upper 102 and help guide portions of tensioning member 210 from tensioning device 202 to elements of tensioning system 200 disposed in lace guide assembly area 220. In this way, first guide tube 230 and second guide tube 232 may help control the paths of tensioning member 210 in passing from sole structure 106 to lace guide assembly area 220, and may also help reduce friction between tensioning member 210 and sole structure 106 and/or upper 102 adjacent where upper 102 and sole structure 106 are attached.

Figure 5:
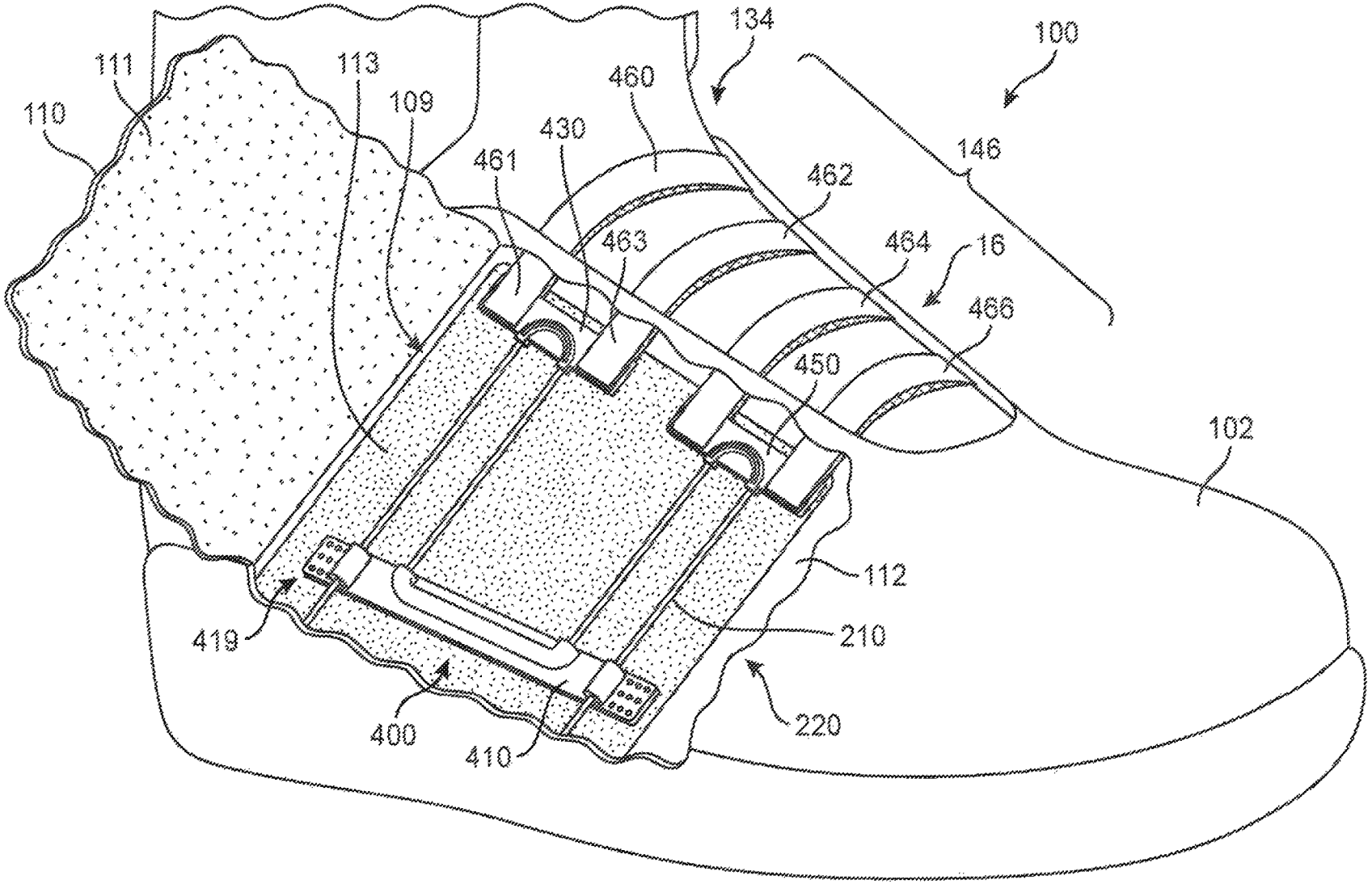
FIG. 5 is a schematic isometric enlarged view of an embodiment of an article of footwear with a lace guide assembly.

FIG. 5 is a schematic isometric view of a portion of article 100, in which a portion of outer layer 110 of upper 102 in lace guide assembly region 220 has been peeled away to reveal components of lace guide assembly 400. Referring to FIG. 5, lace guide assembly 400 includes lower guide member 410, first upper guide member 430, and second upper guide member 450.

Figure 6:
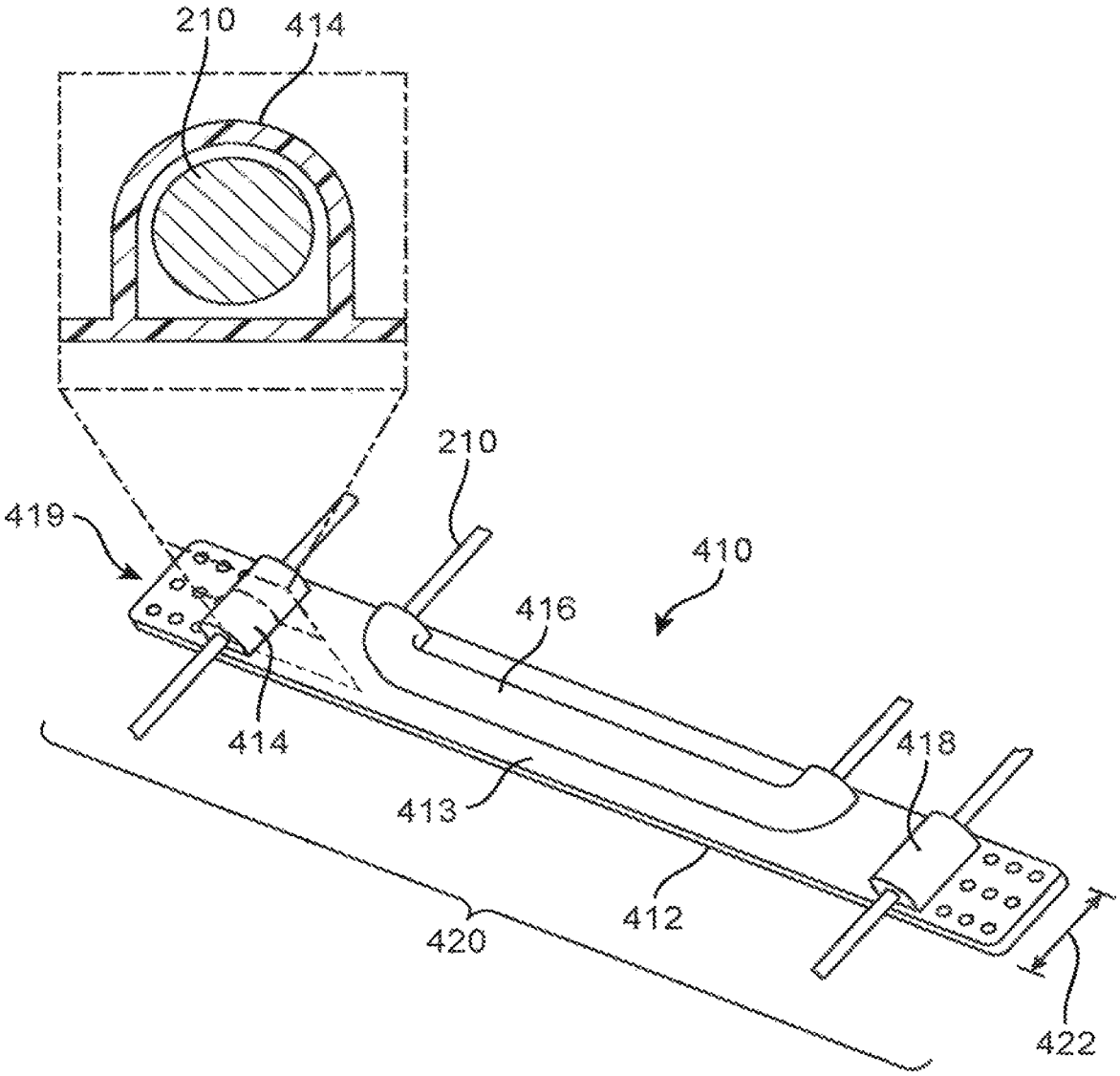
FIG. 6 is a schematic isometric view of an embodiment of a lower guide member.

FIG. 6 is a schematic isometric view of an embodiment of lower guide member 410 shown in isolation. Referring now to FIG. 6, lower guide member 410 is comprised of lower base portion 412. Lower base portion 412 may be characterized by lower base outer surface 413 and an opposing lower base inner surface (not shown). First lower guide channel 414, second lower guide channel 416, and third lower guide channel 418 all extend from lower base outer surface 413 of lower base portion 412.

In different embodiments, the orientations of each lower guide channel could vary. As seen in FIG. 6, first lower guide channel 414 may extend across a width of lower guide member 410. Similarly, third lower guide channel 418 may extend across a width of lower guide member 410. In contrast, second lower guide channel 416 may extend in a lengthwise direction of lower guide portion 410. In the exemplary embodiment, lower guide portion 410 has a longer length 420 than width 422 (both of which are greater than its thickness). Moreover, second lower guide channel 416 has a greater length than both first lower guide channel 414 and third lower guide channel 418.

Figure 7:
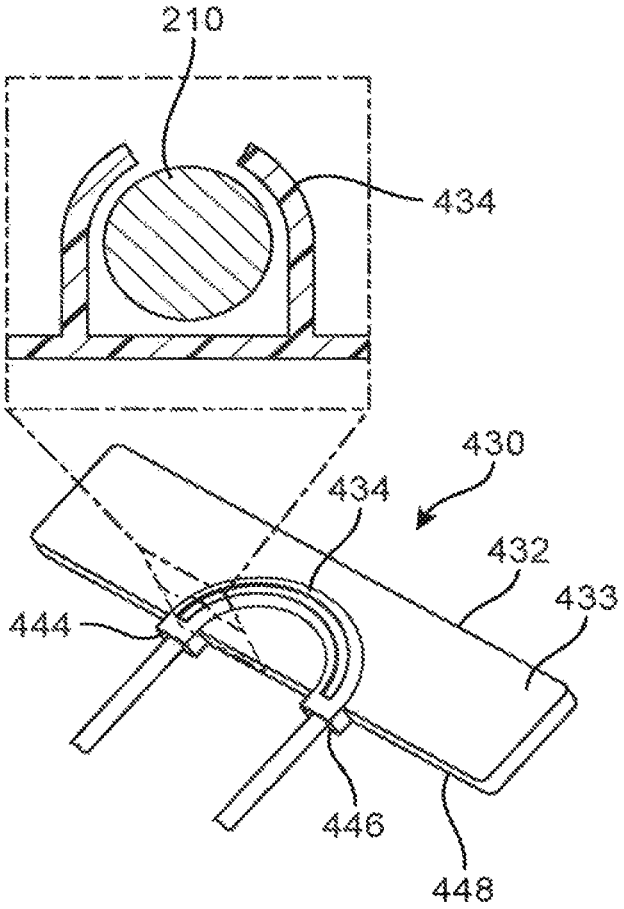
FIG. 7 is a schematic isometric view of an embodiment of an upper guide member.

FIG. 7 is a schematic isometric view of an embodiment of first upper guide member 430 shown in isolation. Referring now to FIG. 7, first upper guide member 430 is comprised of upper base portion 432. Upper base portion 432 may be characterized by upper base outer surface 433 and an opposing upper base inner surface (not shown). Upper guide channel 434 extends from upper base outer surface 433 of first upper guide member 430. In the embodiment of FIG. 7, upper guide channel 434 has an arch-like shape, with both first end 444 and second end 446 of upper guide channel 434 being disposed at a common lower edge 448 of first upper guide member 430. However, in other embodiments, upper guide channel 434 could have any other shape, including both linear channel shapes and/or non-linear channel shapes.

It may be understood that in at least some embodiments, second upper guide member 450, seen in FIG. 5, may be configured in a similar manner to first upper guide member 430. Specifically, second upper guide member 450 can include a corresponding base portion and upper guide channel.

In different embodiments, the shapes of each guide channel could vary. In some embodiments, a guide channel may have an open-channel or groove-like configuration. In other embodiments, a guide channel may have a closed-channel or tunnel-like configuration. As seen in the enlarged cross-sectional view within FIG. 6, first lower guide channel 414 has a closed and tubular cross-sectional geometry. It may be understood that in some embodiments, second lower guide channel 416 and third lower guide channel 418 may have similar closed and tubular cross-sectional geometries. Moreover, as shown in FIG. 7, upper guide channel 434 has an open-channel configuration, except at first end 444 and second end 446 where upper guide channel has a closed tunnel structure. Similarly, it may be understood that in the exemplary embodiments of FIGS. 5-7, second upper guide member 450 has a similar channel geometry to that of upper guide channel 434.

While the diameters of one or more guide channels could vary, they may generally be selected to easily fit a section of a tensioning member. Thus, the particular diameter, or minimum diameter, for each guide channel may depend on the diameter of lace or cord used (and vice versa) in the system.

Generally, the sizes, shapes, and orientations of each guide channel of lace guide assembly 400 may be selected to achieve a particular arrangement or path for a tensioning member that distributes tension so as to provide smooth and precise control for opening, closing, and incrementally tightening article 100 around a foot. It may, therefore, be appreciated that the sizes, shapes, and/or orientations of one or more guide channels could be varied to achieve other desired paths for a tensioning member so as to modify the locations where tension is directly applied within article 100.

A guide member assembly may be secured within a pocket, gap, cavity, or void formed within the side of an upper. Referring now to FIG. 5, lace guide assembly 400 may be disposed between outer layer 110 and inner layer 112 in interior cavity 109, and thereby hidden from view. Moreover, lower guide member 410 may be disposed on article 100 at a region adjacent where upper 102 and sole structure 106 are attached (e.g., a lower peripheral edge of upper 102 or an upper peripheral edge of sole structure 106). In at least some embodiments, lower guide member 410 may be mounted so that some part of it is below the bite line of article 100 and thus hidden in part by sole structure 106. Lower guide member 410 may also be attached directly to outward facing surface 113 of inner layer 112 of upper 102. In at least some embodiments, lower guide member 410 could be secured to inner layer 112 using stitching that can be threaded through mounting holes 419 of lower guide member 410. Alternatively, in some embodiments, lower guide member 410 could be bonded directly to inner layer 112 using, for example, an adhesive, ultrasonic welds, or other known bonding provisions. It is also contemplated that in at least some embodiments, lower guide member 410 may not be fixed in place relative to inner layer 112 and instead could float in the space (e.g., interior cavity 109) formed between outer layer 110 and inner layer 112 of upper 102.

In the embodiment shown in FIG. 5, first upper guide member 430 and second upper guide member 450 may be attached directly to plurality of strap members 146. Specifically, first strap member 460 has first strap end 461 attached to first upper base end 440 of first upper guide member 430 and second strap member 462 has second strap end 463 attached to second upper base end 442 of first upper guide member 430. In a similar manner, third strap member 464 and fourth strap member 466 each have an end attached to a portion of second upper guide member 450. Thus, first upper guide member 430 and second upper guide member 450 are directly coupled to plurality of strap members 146, with each upper guide member being attached to two of the four total strap members.

In the exemplary embodiments, first upper guide member 430 and second upper guide member 450 are disposed closer to throat opening 134 than lower guide member 410 is to throat opening 134. This configuration ensures that as first upper guide member 430 and second upper guide member 450 are pulled closer to lower guide member 410, plurality of strap members 146 are pulled tight across instep region 16 to tighten upper 102.

Some embodiments can include provisions to help a tensioning member pass through lace guide assembly area 220 with minimal friction. In the embodiment shown in FIG. 5, one or more surfaces between outer layer 110 and inner layer 112 of upper 102 may comprise a low-friction material. In some embodiments, inward facing surface 111 of outer layer 110 and outward facing surface 113 of inner layer 112 may both comprise a coating of low-friction material, such as Teflon. Moreover, in some cases, one or more guide channels of lace guide assembly 400 could be coated with a substantially low-friction material and/or each guide member could be formed of a material having a substantially low coefficient of friction relative to the tensioning member received within lace guide assembly 400.

As seen in FIG. 5, tensioning member 210 passes through the various guide channels of lace guide assembly 400 and thereby provides a coupling between tensioning device 202 (seen in FIGS. 2-4) and plurality of strap members 146. For purposes of clarity, FIG. 8 illustrates a schematic view of lace guide assembly 400 in isolation from article 100 to clarify the routing of tensioning member through various lace guide channels in the present embodiment.

Figure 8:
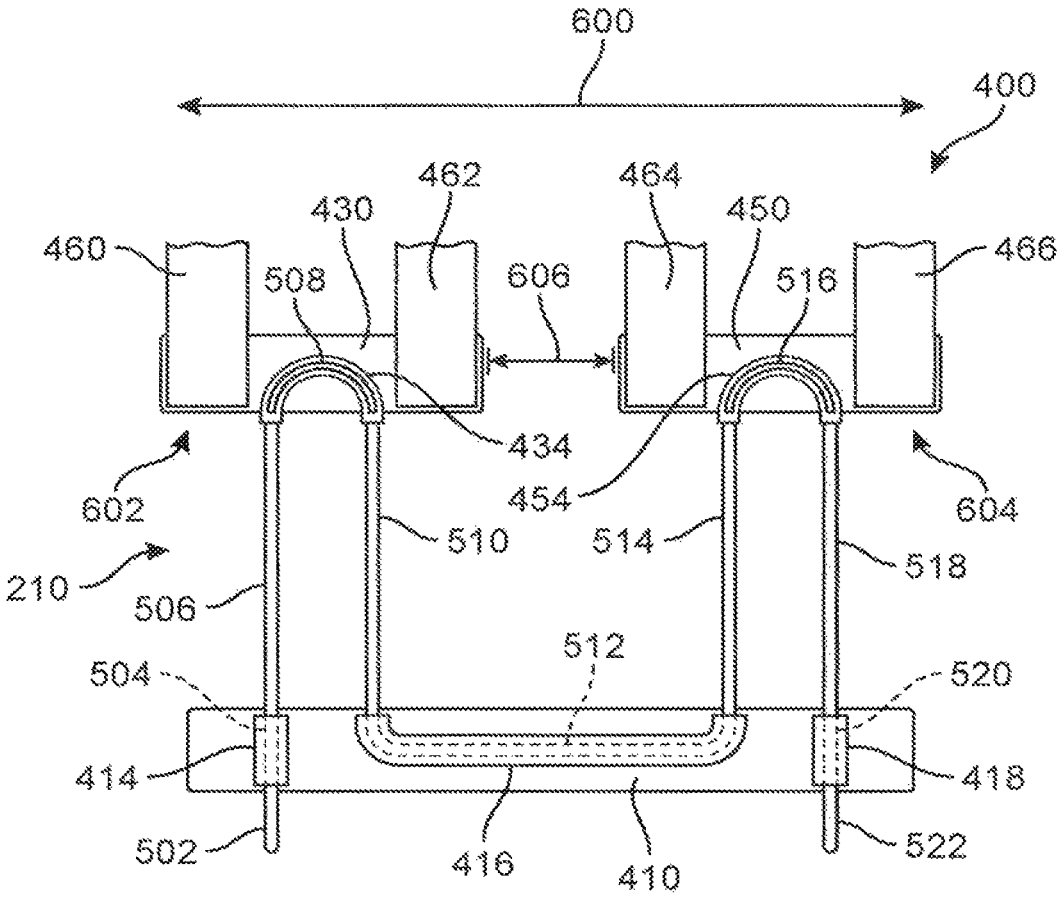
FIG. 8 is a schematic view of an embodiment of components in a lace guide assembly shown in isolation from an article of footwear.

Referring now to FIG. 8, tensioning member 210 may be comprised of various segments including first segment 502, second segment 504, third segment 506, fourth segment 508, fifth segment 510, sixth segment 512, seventh segment 514, eighth segment 516, ninth segment 518, tenth segment 520, and eleventh segment 522. First segment 502 extends from outside interior cavity 109 (i.e., from outside the region disposed between outer layer 110 and inner layer 112) to first lower guide channel 414 of lower guide member 410. Second segment 504 extends through first lower guide channel 414, entering and exiting through opposing openings in first lower guide channel 414. Third segment 506 extends from first lower guide channel 414 to upper guide channel 434 of first upper guide member 430. Fourth segment 508 extends through upper guide channel 434. Fifth segment 510 extends from upper guide channel 434 to second lower guide channel 416 of lower guide member 410. Sixth segment 512 extends through second lower guide channel 416, entering and exiting through opposing openings in second lower guide channel 416. Seventh segment 514 extends from second lower guide channel 416 of lower guide member 410 to second upper guide channel 454 of second upper guide member 450. Eighth segment 516 extends through second upper guide channel 454. Ninth segment 518 extends from second upper guide channel 454 of second upper guide member 450 to third lower guide channel 418 of lower guide member 410. Tenth segment 520 extends through third lower guide channel 418. Finally, eleventh segment 522 extends from third lower guide channel 418 to another location outside of interior cavity 109.

The routing configuration for tensioning member 210 allows first upper guide member 430 and second upper guide member 450 to be independently pulled. This independent adjustment allows for the adjustment of first strap member 460 and second strap member 462 independently from the adjustment of third strap member 464 and fourth strap member 466, which may improve comfort and fit as upper 102 is tightened around a foot.

Each guide member may be positioned within lace guide assembly area 220 so as to ensure plurality of strap members 146 are properly tightened. As seen in FIG. 8, first upper guide member 430 has first longitudinal position 602 with respect to longitudinal axis 600 of article 100. Second upper guide member 450 has second longitudinal position 604 with respect to longitudinal axis 600. First upper guide member 430 and second upper guide member 450 are also separated, or spaced apart, by distance 606. Moreover, at least a portion of lower guide member 410 extends from first longitudinal position 602 along longitudinal axis 600 to second longitudinal position 604. This allows tensioning forces to be primarily oriented in directions between the upper guide members and lower guide member 410, and reduces the tendency of forces to be directed in the longitudinal direction. Specifically, the use of a sufficiently rigid lower guide member 410 that spans the longitudinal spacing of the two upper guide members helps prevent collapsing or cinching of the upper in the longitudinal direction.

Figure 9:
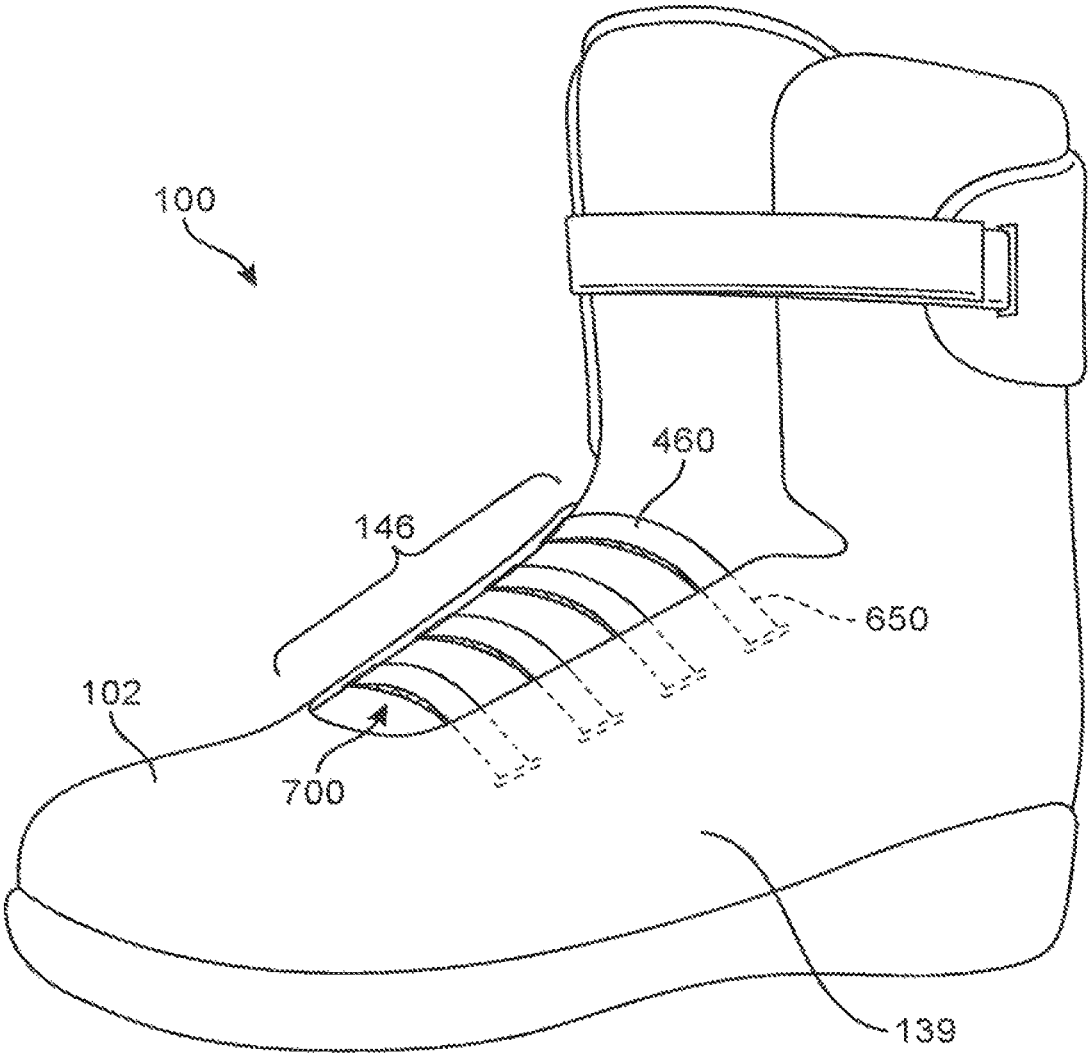
FIG. 9 is another schematic isometric view of the article of footwear of FIG. 1.
Figure 10:
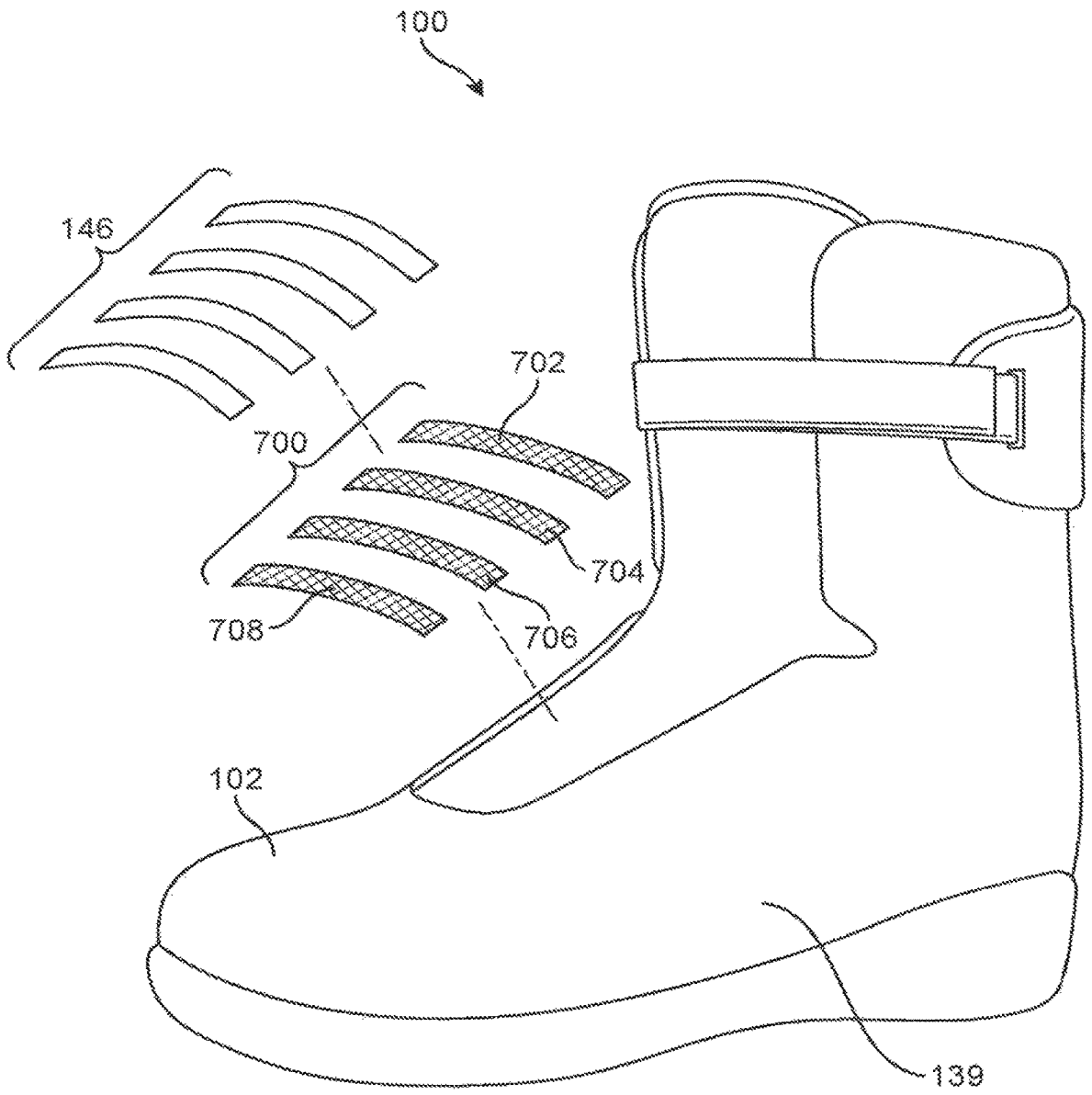
FIG. 10 is a schematic isometric view of the article of footwear of FIG. 9 in which one or more strap members have been exploded from an upper.

FIGS. 9 and 10 illustrate a schematic isometric view and an exploded isometric view, respectively, of an embodiment of article 100. As seen in FIG. 9, each strap member of plurality of strap members 146 includes an end secured to second side 139 of upper 102. In other words, each strap member includes an end secured to an opposing side of upper 102 from the side that incorporates lace guide assembly 400. In contrast to the attachment of strap member ends to upper guide members on first side 138, the ends attached to second side 139 may be fixedly secured or fixedly attached in place. Such attachment could be achieved using any known methods including stitching, adhesive bonding, welding, or other techniques. As shown in FIG. 9, end 650 of first strap member 460 is stitched to an inner or outer layer of upper 102 on second side 139.

Embodiments can include provisions to facilitate loosening an upper around a foot when a tensioning device has ceased applying tension to the system (i.e., a motor has stopped and a spool holding a tensioning member is free to unwind the tensioning member). In some embodiments, an article can incorporate one or more components that provide a restoring force that counters any forces in a system that would tend to keep a tensioning member wound on a spool even when a tensioning device stops applying tension directly. As one example, embodiments could include one or more elastic members that stretch as the upper is tightened and, therefore, tend to contract to a non-stressed size when the tension used to tighten the upper is released.

Referring to FIGS. 9-10, article 100 may include plurality of elastic band members 700 that are in one-to-one correspondence with plurality of strap members 146. Specifically, plurality of elastic band members 700 includes first elastic band member 702, second elastic band member 704, third elastic band member 706, and fourth elastic band member 708.

In different embodiments, the size and geometry of each elastic band member could vary. In some embodiments, each elastic band member is configured to have a similar size and shape to a corresponding strap in plurality of strap members 146. In other embodiments, however, the size and shape of one or more elastic band members could vary. For example, in an alternative embodiment, a single elastic band or elastic layer could be used. Such an elastic layer could have a width equivalent to the area spanned by plurality of strap members 146 on instep region 16 of upper 102. In still another embodiment, a single set of elastic band members could be used to both tighten an upper and to help pull on a tensioning member when tension is released.

As indicated in FIGS. 9-10, each elastic band member may include an end fixedly attached to second side 139 of upper 102, and an opposing end attached to an upper guide member in lace guide assembly 400 on first side 138. In some cases, the ends of each elastic band member could be secured at adjacent locations to the ends of each corresponding strap member of plurality of strap members 146.

Figure 11:
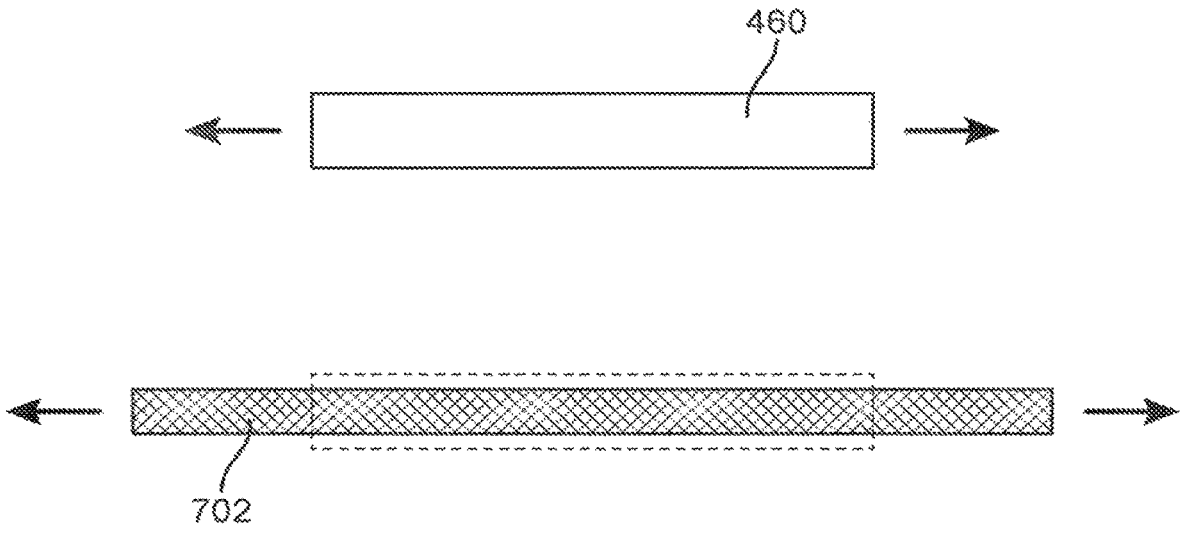
FIG. 11 is a schematic view of an embodiment of a strap member and an elastic band member.

An elastic band member of plurality of elastic band members 700 may have a lower modulus of elasticity (i.e., be more elastic) than a strap member of plurality of strap members 146. For example, FIG. 11 illustrates a schematic view of an embodiment of first strap member 460 and first elastic band member 702 with equal tensioning forces applied at opposing ends. As clearly shown, first elastic band member 702 becomes elongated under the applied forces, while first strap member 460 remains substantially unchanged in length being made of a relatively inelastic material. It may be appreciated that the degree of relative elasticity between plurality of strap members 146 and plurality of elastic band members 700 could vary according to factors. These factors include the required tensioning forces to properly tighten upper 102 around a foot and the amount of restoring force required to pull tensioning member 210 from a spool when there is slack in the system.

Figure 12:
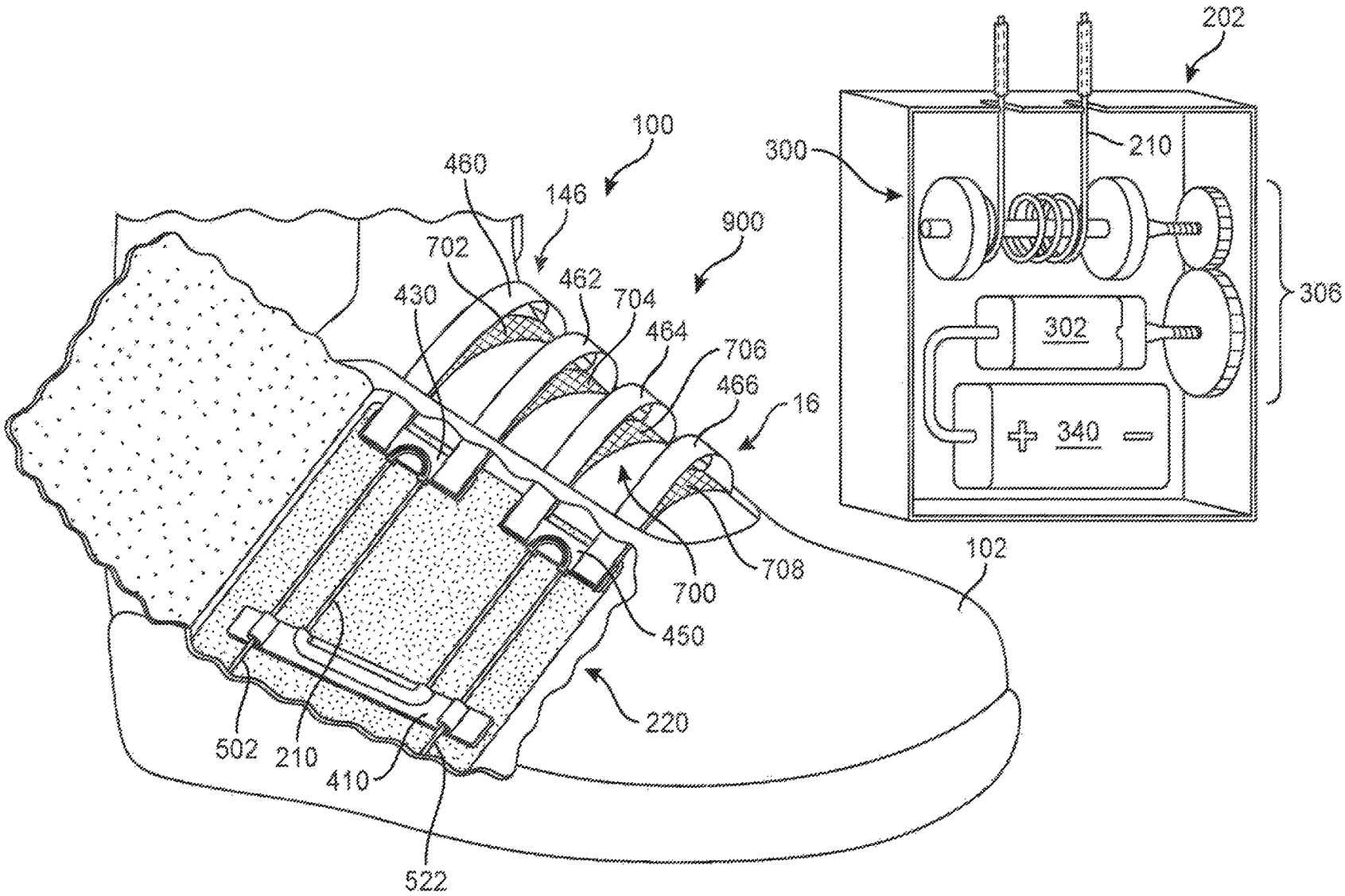
FIG. 12 is a schematic view of an embodiment of an article of footwear with a lace guide assembly in a fully loosened state.

As clearly shown in FIG. 12, in a loosened state of upper 102, plurality of strap members 146 may bow upwards from instep region 16 due to slack. In contrast, plurality of elastic band members 700 are pulled taut across instep region 16, even when upper 102 is loose. This ensures that as upper 102 is tightened, plurality of elastic band members 700 will stretch and generate a restoring force that can be used to help pull tensioning member 210 from tensioning device 202 when the system is switched to back to a loosened state again.

FIGS. 12-17 illustrate various schematic views of article 100 as tensioning system 200 is operated to tighten and loosen article 100. For purposes of clarity, each view includes an enlarged schematic view of tensioning device 202 so as to relate the operation of tensioning device 202 and various configurations of lace guide assembly 400.

Figure 13:
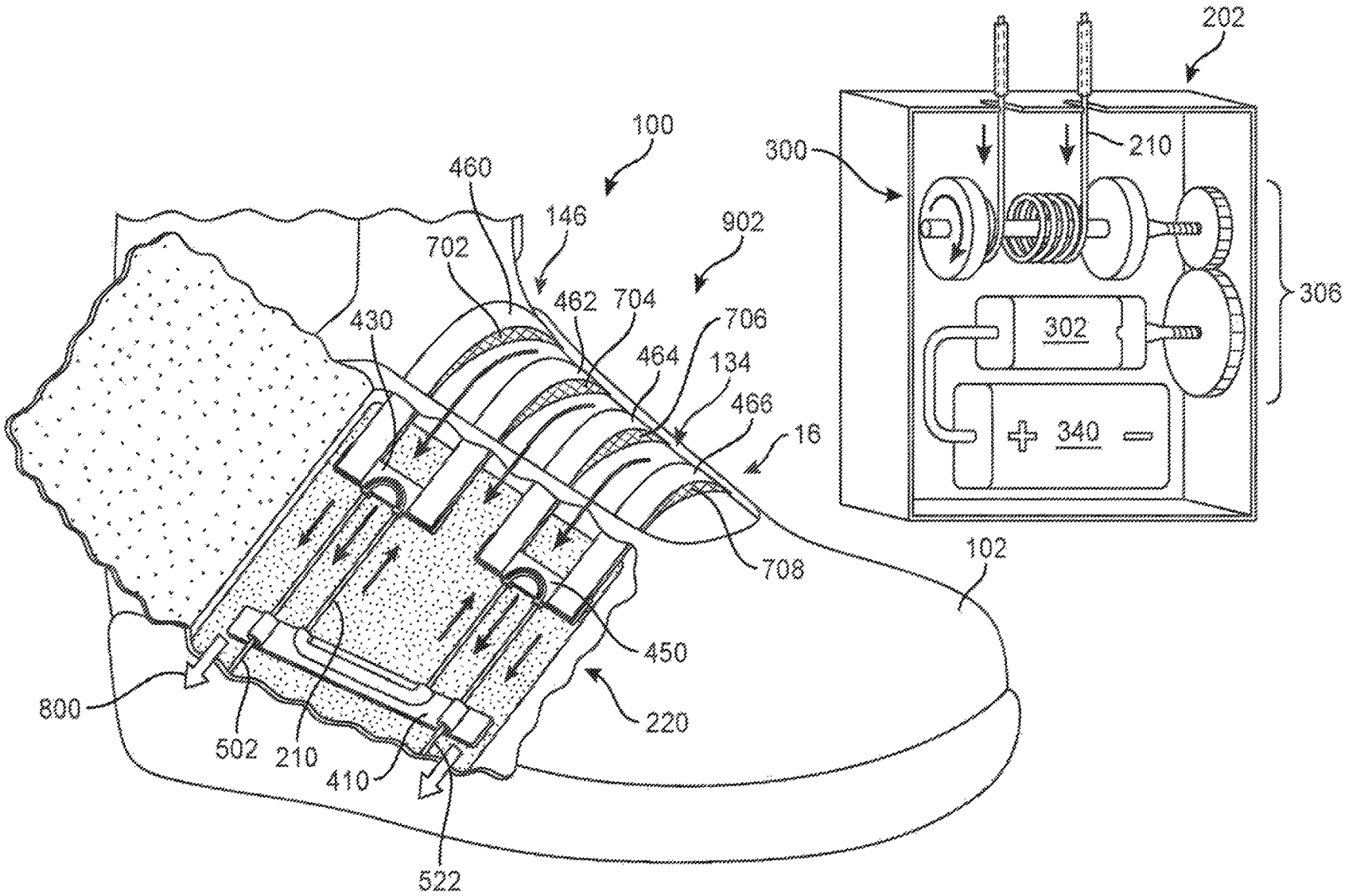
FIG. 13 is a schematic view of the article of footwear of FIG. 12, in which the article is being actively tightened.
Figure 14:
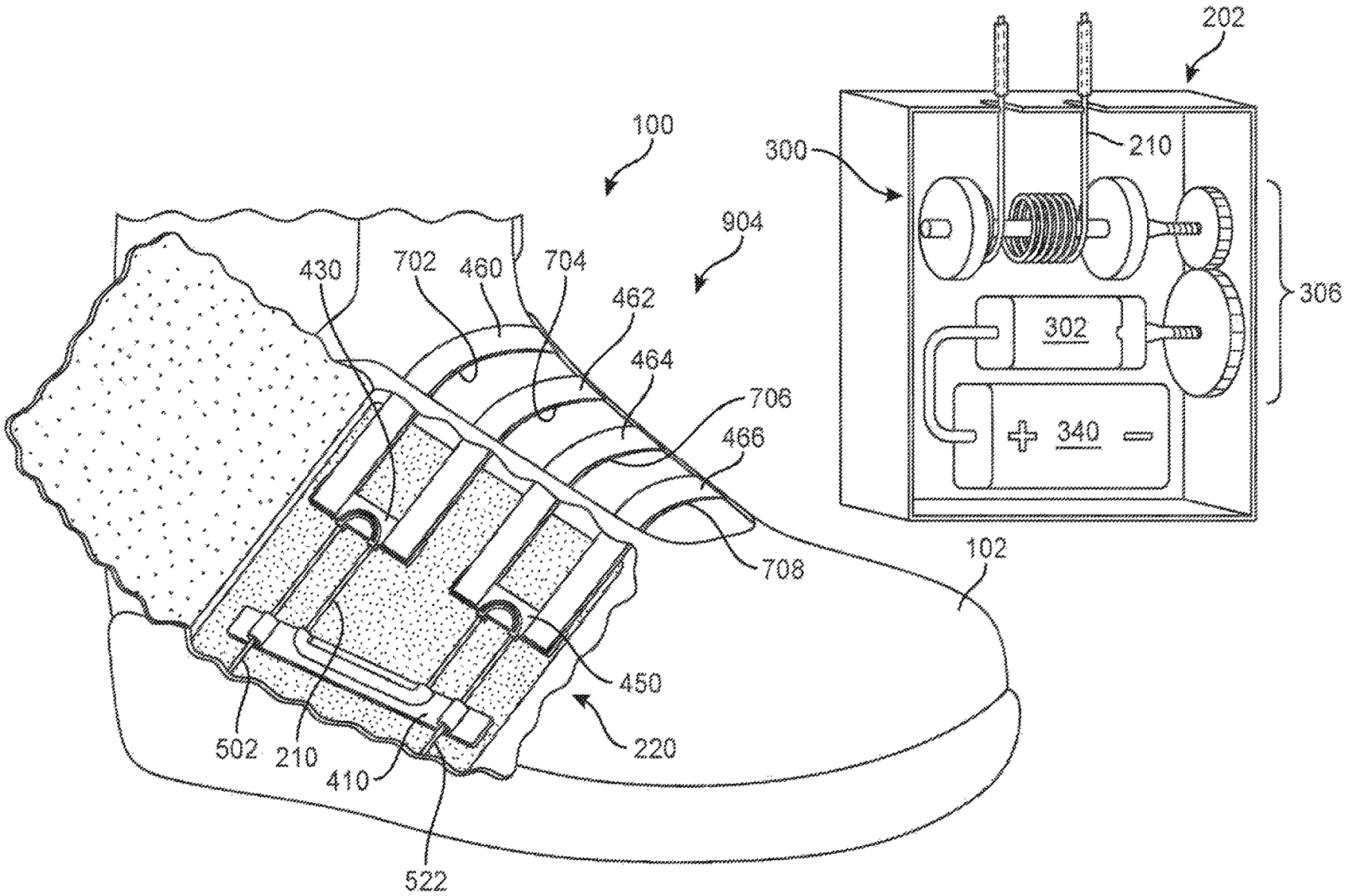
FIG. 14 is a schematic view of the article of footwear of FIG. 12 in a tightened state.

FIGS. 12 through 14 illustrate a sequence of isometric views of article 100 as it moves from fully loosened state 900 (FIG. 12) to fully tightened state 904 (FIG. 14) and passes through intermediate or partially tightened state 902 (FIG. 13). In fully loosened state 900, tensioning member 210 experiences no net tension at first segment 502 or eleventh segment 522 of tensioning member 210 and so stays motionless in lace guide assembly area 220. When tensioning device 202 begins to wind tensioning member 210 onto reel member 300 (using motor 302), net tensioning forces 800 at first segment 502 and/or eleventh segment 522 act to pull tensioning member 210 into tensioning device 202 and reduce the length of tensioning member 210 in lace guide assembly area 220, which is seen in FIG. 13. This acts to pull first upper guide member 430 and second upper guide member 450 toward lower guide member 410. As first upper guide member 430 and second upper guide member 450 are pulled toward lower guide member 410, they themselves pull plurality of strap members 146 across instep region 16 and thereby reduce the size of throat opening 134 and of the interior void within upper 102.

Once in the fully tightened state of FIG. 14, motor 302 stops rotating reel member 300. In some embodiments, tensioning device 202 includes provisions for automatically locking reel member 300 in a fixed rotational position so that reel member 300 does not unwind when motor 302 stops while the system is still in the fully tightened state. Such provisions could be associated with reel member 300, gear assembly 306, and/or motor 302.

Figure 15:
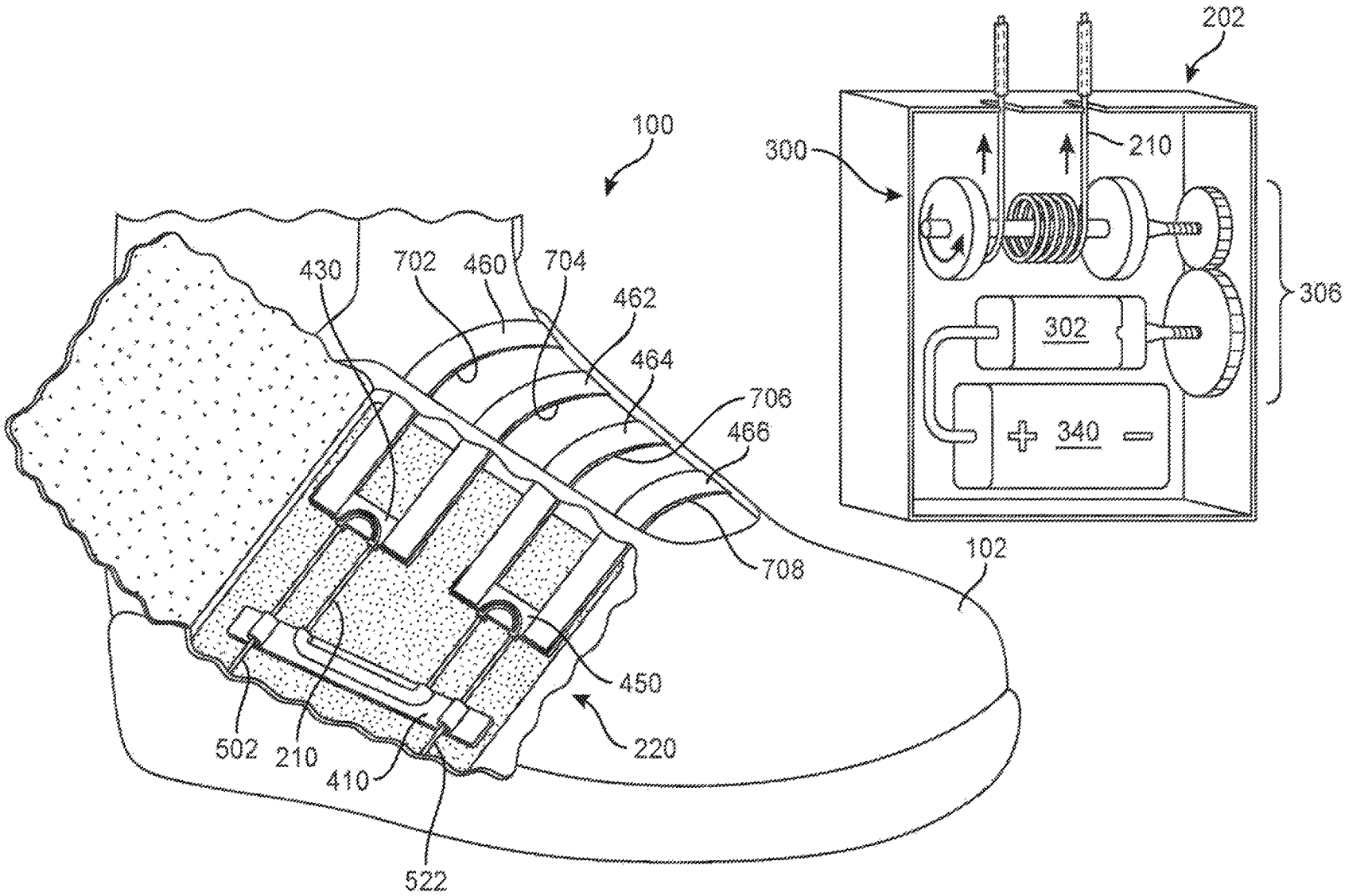
FIG. 15 is a schematic view of the article of footwear of FIG. 12 as a tensioning member is unwound from a reel.
Figure 16:
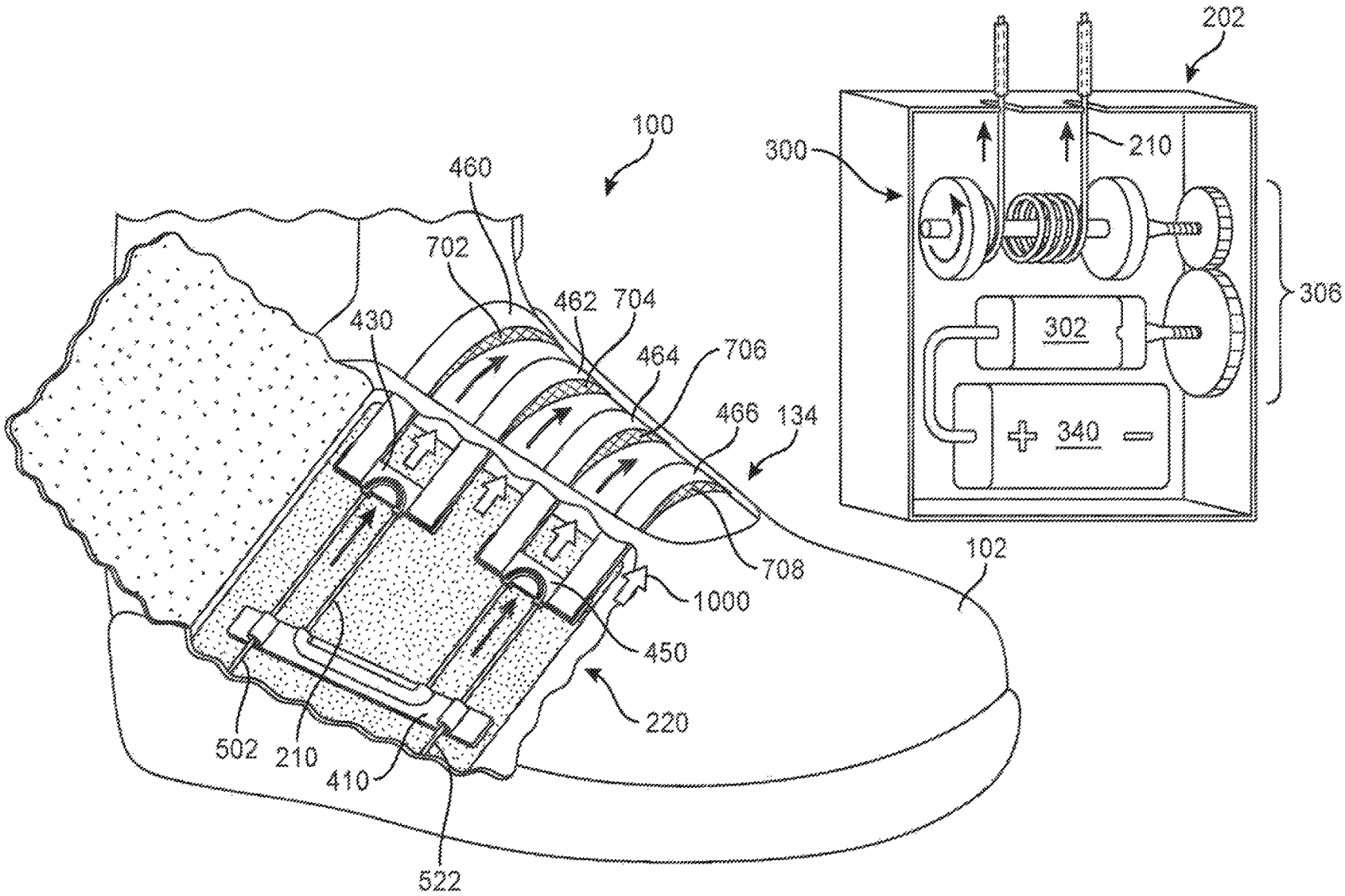
FIG. 16 is a schematic view of the article of footwear of FIG. 12, in which a plurality of elastic band members pull on a tensioning member to help unwind a tensioning member from a reel.
Figure 17:
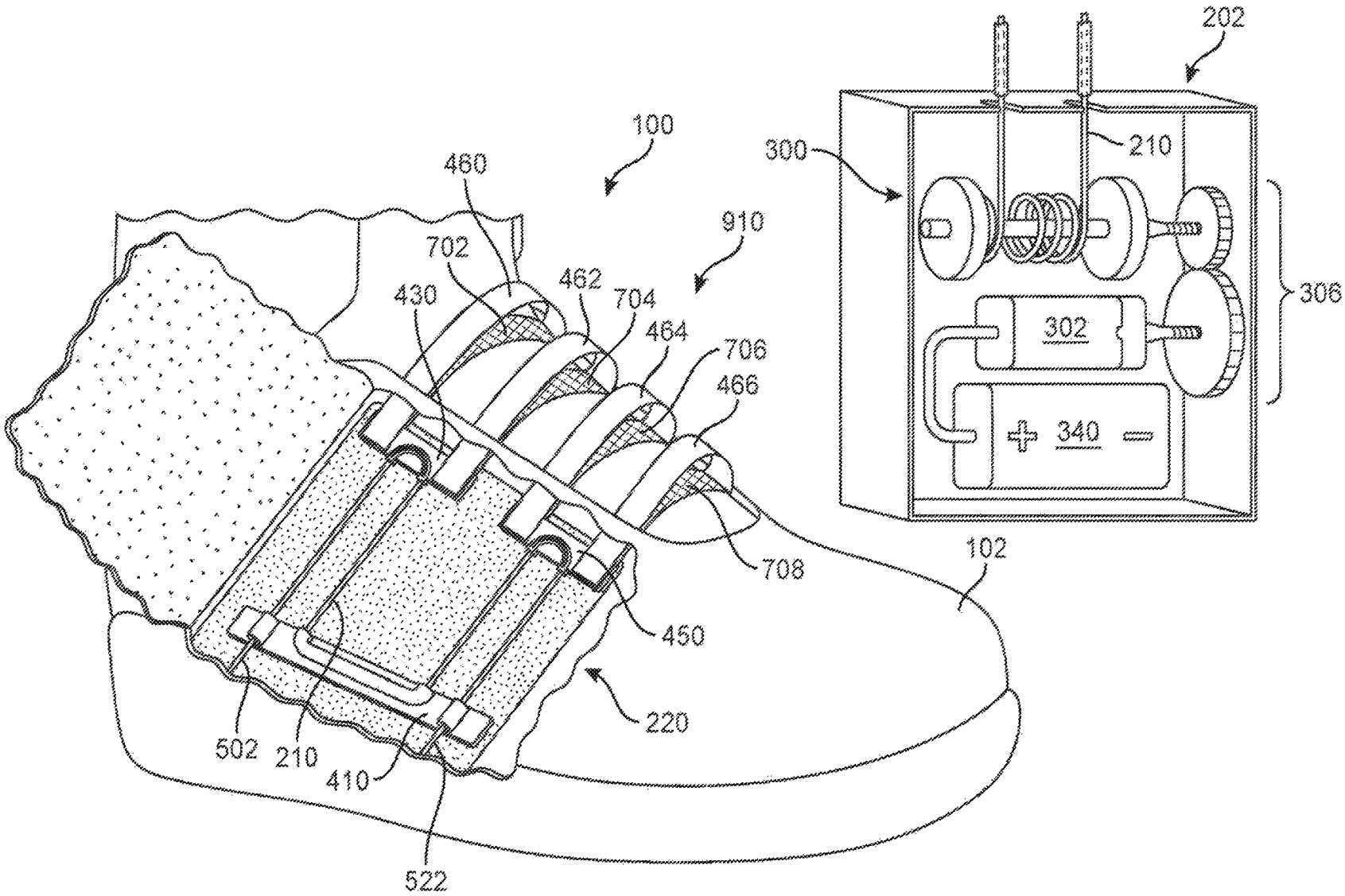
FIG. 17 is a schematic view of the article of footwear of FIG. 12 as it has returned to a fully loosened state.

FIGS. 15 through 17 illustrate several schematic views in a sequence as article 100 is moved from the fully tightened state 904 of FIG. 14 back to fully loosened state 910 (FIG. 17), including two intermediate or partially loosened states (FIGS. 15-16). As seen in FIG. 15, in at least some embodiments, loosening article 100 proceeds by driving motor 302 in a reverse direction as the direction that motor 302 is driven to tighten article 100. In some other embodiments, loosening article 100 proceeds by releasing provisions that have locked reel member 300 in a fixed rotational position, thereby allowing tension elsewhere in the system to begin unwinding tensioning member 210 from reel member 300.

As seen in FIG. 15, however, frictional forces in the system may limit the length of tensioning member 210 that may unwind from reel member 300. To help ensure tensioning member 210 is properly unwound from reel member 300 and thus that article 100 is fully opened when fully loosened, the system makes use of the restoring force provided by one or more elastic band members.

As seen in FIG. 16, elastic band members 700 apply forces 1000 on first upper guide member 430 or second upper guide member 450. This pulls the guide members away from lower guide member 410, thereby increasing the length of tensioning member 210 in lace assembly guide area 220. This helps to expand throat opening 134 and pulls tensioning member 210 off of reel member 300 and returns article 100 to fully loosened state 910.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear, comprising:

an upper forming a throat opening;

a sole structure;

a tensioning member;

a tensioning device including a reel member and a motor, the tensioning device disposed in at least one of the upper and the sole structure, wherein a portion of the tensioning member is joined to the reel member so that the tensioning member can be wound and unwound from the reel member;

a guide member, secured to the upper, configured to guide the tensioning member; and a plurality of tightening members, secured to the guide member and to the upper, each tightening member of the plurality of tightening members extending across various portions of the throat of the upper;

wherein the tensioning member transmits tension to the tightening members by applying force to the guide member as the tensioning member is wound around the reel member.

2. The article of footwear of claim 1, wherein the guide member is an elongate guide member having a first end and a second end, wherein a first tightening member of the plurality of tightening members is secured proximate the first end and a second tightening member of the plurality of tightening members is secured proximate the second end.

3. The article of footwear of claim 2, wherein the guide member comprises a channel, configured to guide the tensioning member, positioned between, at least in part, the first tightening member and the second tightening member.

4. The article of footwear of claim 3, wherein the channel is a curved channel.

5. The article of footwear of claim 2, wherein the elongate guide member is a first elongate guide member, and further comprising a second elongate guide member having a first end and a second end, wherein a third tightening member of the plurality of tightening members is secured proximate the first end and a fourth tightening member of the plurality of tightening members is secured proximate the second end.

6. The article of footwear of claim 5, further comprising a lower guide member positioned between the first and second elongate guide members and the sole structure, wherein the lower guide member comprises a plurality of channels configured to guide the tensioning member.

7. The article of footwear of claim 6, wherein the plurality of channels comprise: a first channel configured to direct the tensioning member from the tensioning device to the first elongate guide member; a second channel configured to direct the tensioning member from the first elongate guide member to the second elongate guide member; and a third channel configured to direct the tensioning member from the second elongate guide member to tensioning device.

8. An article of footwear, comprising:

an upper forming a throat opening;

a guide member, secured to the upper, configured to guide a tensioning member; and a plurality of tightening members, secured to the guide member and to the upper, each tightening member of the plurality of tightening members extending across various portions of the throat of the upper;

wherein the tensioning member transmits tension to the tightening members by applying force to the guide member as the tensioning member is wound around a reel member;

wherein the guide member is an elongate guide member having a first end and a second end, wherein a first tightening member of the plurality of tightening members is secured proximate the first end and a second tightening member of the plurality of tightening members is secured proximate the second end;

wherein the elongate guide member is a first elongate guide member, and further comprising a second elongate guide member having a first end and a second end, wherein a third tightening member of the plurality of tightening members is secured proximate the first end and a fourth tightening member of the plurality of tightening members is secured proximate the second end; and further comprising a lower guide member positioned between the first and second elongate guide members and a sole structure, wherein the lower guide member comprises a plurality of channels configured to guide the tensioning member.

9. The article of footwear of claim 8, wherein the guide member comprises a channel, configured to guide the tensioning member, positioned between, at least in part, the first tightening member and the second tightening member.

10. The article of footwear of claim 9, wherein the channel is a curved channel.

11. The article of footwear of claim 8, wherein the plurality of channels comprise: a first channel configured to direct the tensioning member from the tensioning device to the first elongate guide member; a second channel configured to direct the tensioning member from the first elongate guide member to the second elongate guide member; and a third channel configured to direct the tensioning member from the second elongate guide member to tensioning device.

12. An article of footwear, comprising:

an upper forming a throat opening;

a sole structure;

a tensioning member;

a tensioning device including a reel member and a motor, the tensioning device disposed in at least one of the upper and the sole structure, wherein a portion of the tensioning member is joined to the reel member so that the tensioning member can be wound and unwound from the reel member;

a first elongate guide member and a second elongate guide member, each secured to the upper, configured to guide the tensioning member;

a plurality of tightening members, secured to the first and second elongate guide members and to the upper, each tightening member of the plurality of tightening members extending across various portions of the throat of the upper; and a lower guide member positioned between the first and second elongate guide members and the sole structure, wherein the lower guide member comprises a plurality of channels configured to guide the tensioning member;

wherein the first elongate guide member has a first end and a second end, wherein a first tightening member of the plurality of tightening members is secured proximate the first end and a second tightening member of the plurality of tightening members is secured proximate the second end;

wherein the second elongate guide member has a first end and a second end, wherein a third tightening member of the plurality of tightening members is secured proximate the first end and a fourth tightening member of the plurality of tightening members is secured proximate the second end; and wherein the tensioning member transmits tension to the tightening members by applying force to the first and second elongate guide members as the tensioning member is wound around the reel member.

13. The article of footwear of claim 12, wherein the first and second elongate guide members comprise a channel, configured to guide the tensioning member, positioned between, at least in part, the first tightening member and the second tightening member.

14. The article of footwear of claim 13, wherein the channel is a curved channel.

15. The article of footwear of claim 12, wherein the plurality of channels comprise: a first channel configured to direct the tensioning member from the tensioning device to the first elongate guide member; a second channel configured to direct the tensioning member from the first elongate guide member to the second elongate guide member; and a third channel configured to direct the tensioning member from the second elongate guide member to tensioning device.

* * * * *